United States Patent [19]

Issi

[11] 4,182,212

[45] Jan. 8, 1980

[54] METHOD OF AND APPARATUS FOR AUTOMATICALLY PLAYING ARPEGGIO IN ELECTRONIC MUSICAL INSTRUMENT

[75] Inventor: Sigeki Isii, Hamamatsu, Japan

[73] Assignee: Nippon Gakki Seizo Kabushiki Kaisha, Hamamatsu, Japan

[21] Appl. No.: 814,883

[22] Filed: Jul. 12, 1977

[30] Foreign Application Priority Data

Jul. 12, 1976 [JP] Japan ..... 51-82748

[51] Int. Cl.[2] ..... G10H 1/00; G10H 5/00

[52] U.S. Cl. ..... 84/1.03; 84/1.24

[58] Field of Search ..... 84/1.01, 1.03, 1.17, 84/1.24, DIG. 12, DIG. 22

[56] References Cited

U.S. PATENT DOCUMENTS

| | | | |
|---|---|---|---|
| 3,617,602 | 11/1971 | Kniepkamp | 84/1.17 |
| 3,718,748 | 2/1973 | Bunger | 84/1.24 |
| 3,725,562 | 4/1973 | Munch, Jr. et al. | 84/1.24 |
| 3,780,203 | 12/1973 | Petrie | 84/1.17 |
| 3,842,182 | 10/1974 | Bunger | 84/1.03 |
| 3,842,184 | 10/1974 | Kniepkamp et al. | 84/1.01 |
| 3,854,366 | 12/1974 | Deutsch | 84/1.24 |
| 3,910,150 | 10/1975 | Deutsch et al. | 84/1.24 X |
| 4,054,078 | 10/1977 | Kondo | 84/1.24 |
| 4,059,039 | 11/1977 | Carlson | 84/1.01 |
| 4,080,862 | 3/1978 | Hiyoshi et al. | 84/1.24 |
| 4,106,385 | 8/1978 | Roberts | 84/1.24 |

*Primary Examiner*—Stanley J. Witkowski
*Attorney, Agent, or Firm*—Koda and Androlia

[57] ABSTRACT

An electronic musical instrument including key switches which are connected in a matrix of twelve note lines times six octave lines. The note lines are scanned cyclically at a high speed and the octave lines are detected one by one cyclically to determine the closed key switches. Everytime a closed key switch is detected, the scanning operation pauses for a predetermined period of time and a note indicating signal is delivered. The note indicating signal causes the production of a tone signal of that note for a predetermined octave. The number of the detection cycles is counted by a counter, and the detection of the same note in the next cycle causes the production of a tone signal of the same note for the next octave, the counter causing the shifting of the sounding octave. The octave shifting is repetitively carried out upward or downward or reciprocally within a range of certain octaves. Thus an automatic arpeggio performance is realized.

17 Claims, 13 Drawing Figures

METHOD OF AND APPARATUS FOR AUTOMATICALLY PLAYING ARPEGGIO IN ELECTRONIC MUSICAL INSTRUMENT

BACKGROUND OF THE INVENTION

1. Field of the Invention

The present invention relates to a method of and an apparatus for automatically playing arpeggio using an electronic musical instrument.

2. Prior Art

In general, arpeggio playings are executed manually not only on conventional musical instruments but also on electronic musical instruments. Arpeggio playing is a highly skilled playing technique wherein one note or a plurality of notes extending over plural octaves is repeatedly played. Accordingly, only skillful persons can play arpeggio by now, and the musical compositions which require the player to play arpeggio have been known as those which are extremely difficult to be played.

There have been proposed in the prior art, various electronic musical instruments in which musical tones are produced by means of an electronic circuit technique. In the widely used electronic musical instrument of a keyboard scanning type, the data on notes and octaves of tones to be sounded are obtained by repetitively and sequentially scanning key switches and one specific tone or a plurality of specific tones to be sounded are selected in accordance with the instructions of the obtained key data. In order to play on these types of electronic musical instruments, the player may operate them similarly as on the commonly known conventional or natural musical instruments. He can perform arpeggio playing on them by operating keys corresponding to one specific note or a plurality of specific notes over plural octaves. There have already been proposed some systems for realizing automatic performances in electronic musical instruments. The general principle conventionally employed for practicing automatic performances of these instruments is to take out information of a practical performance by a certain player in the form of electrical signals and to store the information in a memory medium, either analogly or digitally, and to read-out a partitioned or whole portion of the stored performance information as required for reproduction in a form of acoustic information. Particular playing performance by a certain player may indeed be repeatedly reproduced by such a manner, but it is not possible to allow the player to express his own musical idea freely nor possible to allow him to play music which is rich in originality by such a method. Particularly in order for the player to perform artistic playing by freely resorting to highly skillful playing techniques such as arpeggio, the aforementioned conventional principle is not satisfactory. There has, therefore, been a demand for the advent of a novel automatic playing system.

SUMMARY OF THE INVENTION

An object of the present invention is, therefore, to provide a novel automatic arpeggio playing system which allows the player to perform original playing and to create artistic playing which is rich in musical sense.

Another object of the present invention is to provide an automatic arpeggio playing system which enables the player to arbitrarily select to play ascending arpeggio towards the upper octaves and descending arpeggio towards the lower octaves, and also to repeatedly play these ascending and descending arpeggios, as he desires.

It is further the object of the present invention to provide an automatic arpeggio playing system wherein the arpeggio starting from or terminating at the key-depressed octave or the arpeggio starting from or terminating at the octave which has preliminary been determined independently of the depressed key location, may be selectively played.

It is yet, a further object of the present invention to provide an automatic arpeggio playing system wherein the range of octaves to perform arpeggio may be determined as desired.

In keeping with the principles of the present invention, the objects are accomplished by a unique electronic musical instrument including key switches which are connected in a matrix of twelve note lines times six octave lines. The note lines are scanned cyclically at a high speed and the octave lines are detected one by one cyclically to determine the closed key switches. Everytime a closed key switch is detected, the scanning operation pauses for a predetermined period of time and a note indicating signal is delivered. The note indicating signal causes the production of a tone signal of that note for a predetermined octave. The number of the detection cycles is counted by a counter, and the detection of the same note in the next cycle causes the production of a tone signal of the same note for the next octave, the counter causing the shifting of the sounding octave. The octave shifting is repetitively carried out upward or downward or reciprocally within a range of certain octaves. Thus an automatic arpeggio performance is realized.

BRIEF DESCRIPTION OF THE DRAWINGS

The above, as well as other objects, features and advantages of the invention, will become apparent and better understood by reference to the following detailed description when considered in connection with the accompanying drawings wherein:

FIG. 8 is a logic circuit diagram showing the detail of the sounding, octave determining circuit incorporated in the system shown in FIG. 1;

DETAILED DESCRIPTION OF THE INVENTION

Figure 1:
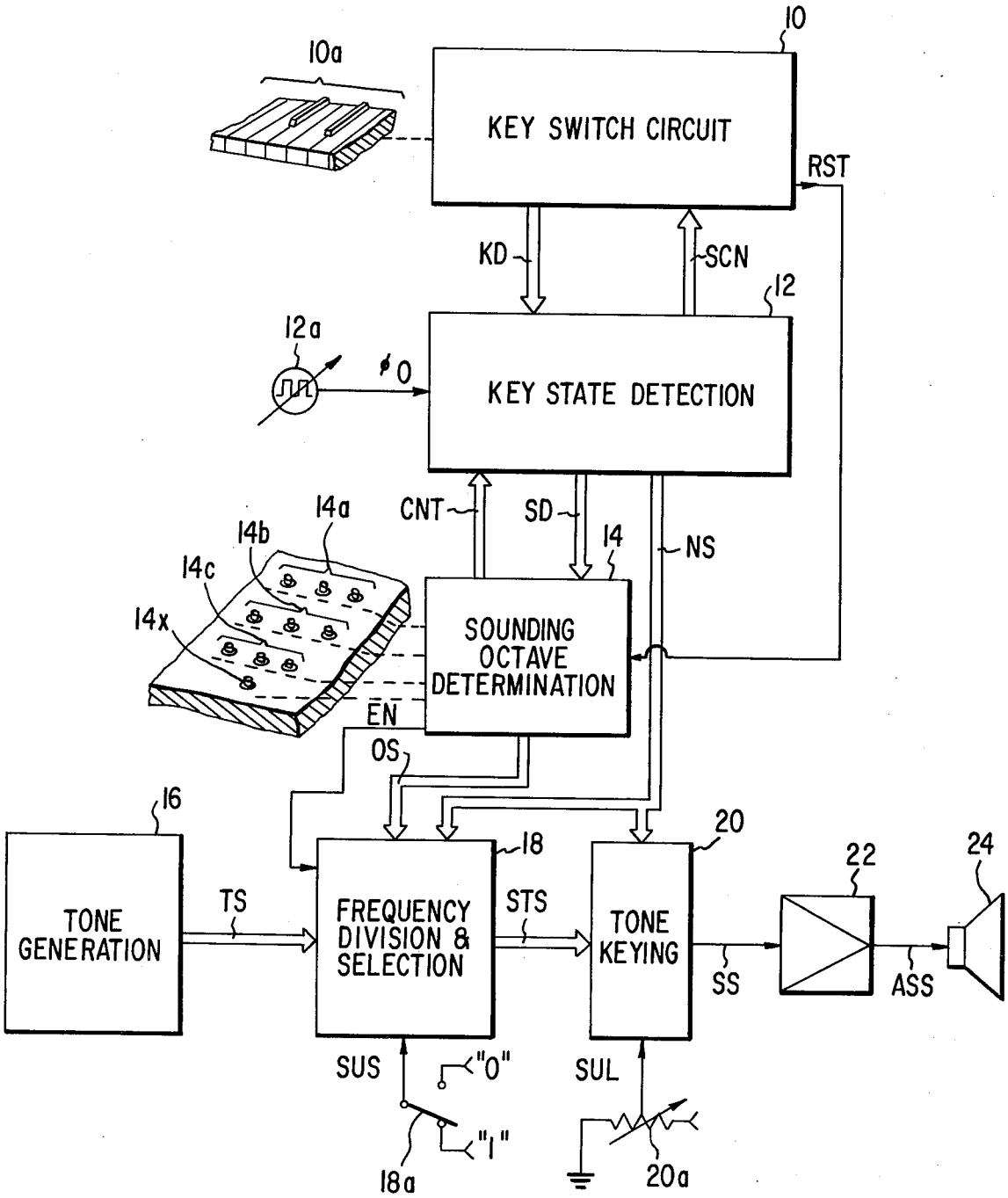
FIG. 1 is a block diagram showing an electronic musical instrument of key scanning type wherein an automatic arpeggio playing system embodying the present invention is adopted.

Referring not to FIG. 1, a key switch circuit 10 comprises a matrix of twelve note lines and six octave lines including a plurality of, for instance sixty-one, key switches which are respectively operated by keys 10*a*, and diodes correspondingly disposed as described hereinafter. Further included is a circuit for generating a reset signal RST which takes logical "0" when a key is depressed and takes logical "1" when the key is not depressed. A key state detecting circuit 12 having a variable frequency clock source 12*a* delivers a signal SCN to the key switch circuit 10 for scanning the key switches from the note lines, and receives the key data KD obtained from the result of scanning for detecting the states of keys to tell which key is depressed. The clock source 12*a* is provided for varying the frequency $\phi_0$ of its output clock signal to change the scanning speed to thereby change the tempo of arpeggio to be played. The key state detecting circuit 12 generates sounding note designating signals NS, and delivers the data SD concerning the scanning operation to a sounding octave determining circuit 14.

The sounding octave determining circuit 14 includes three operation mode setting switches 14*a*, three sounding octave range setting switches 14*b*, three sounding octave limit setting switches 14*c*, and one sounding octave limit releasing switch 14*x*. The sounding octave determining circuitry control signal CNT to the key state detecting circuit 12 and also delivers the enable signal EN to a frequency divider and selector circuit 18. The reset signal RST is fed to the circuit 14 from the key switch circuit 10 for maintaining the sounding octave determining circuit 14 in reset condition when the key is not depressed.

A tone generator 16 generates the tone source signals TS having frequencies which correspond to twelve notes in the top octave, and is provided with more than one, ordinarily twelve, oscillators. The frequencies of the tone source signals TS are divided into the number defined by the required sounding octaves by means of the frequency divider and selector circuit 18. In the illustrated embodiment, they are divided five times into halves, such that the tones are provided over six octaves including the top octave. When the enable signal EN becomes a logical "1", the tone source signals, respectively corresponding to the notes in respective octaves, are selected in response to the instruction of the sounding octave defining signal OS and the sounding note designating signal NS, and the selected tone signal STS is fed to a subsequent tone keying circuit 20. The frequency divider and selector circuit 18 has a sustain switch 18*a*. When the sustain signal SUS is maintained as a logical "1" by the action of this switch 18*a*, the selected signal STS is sustained for predetermined periods of time after the sounding note designating signal NS ceases, and then outputted. In the tone keying circuit 20 which receives the sustain length designating signal SUL from a sustain length designating variable resistor 20*a*, the selected signal STS is gated in response to the sounding note designating signal NS with or without sustain effect. If the selected signal inputs STS are plural, these signals are mixed after the keying operation. An output amplifier 22 amplifies the keyed (sometimes being further mixed) signal SS and puts put the thusly amplified signal ASS to an electro-acoustic converter 24 such as a loud speaker, the the converter 24 converts the amplified tone signal ASS to the corresponding audio signal which is audible as a musical tone.

It is, of course, easy to obtain a desired tone by disposing a filter having an arbitrary frequency characteristic before the output amplifier 22.

Each of the circuit components in the above construction will now be described in detail one by one. However, detailed descriptions of the tone generator 16, the output amplifier 22 and the electro-acoustic converter 24 will be omitted, since they are well known to those skilled in the art and the detailed descriptions thereof are not considered indispensible to understand the present invention.

Figure 2:
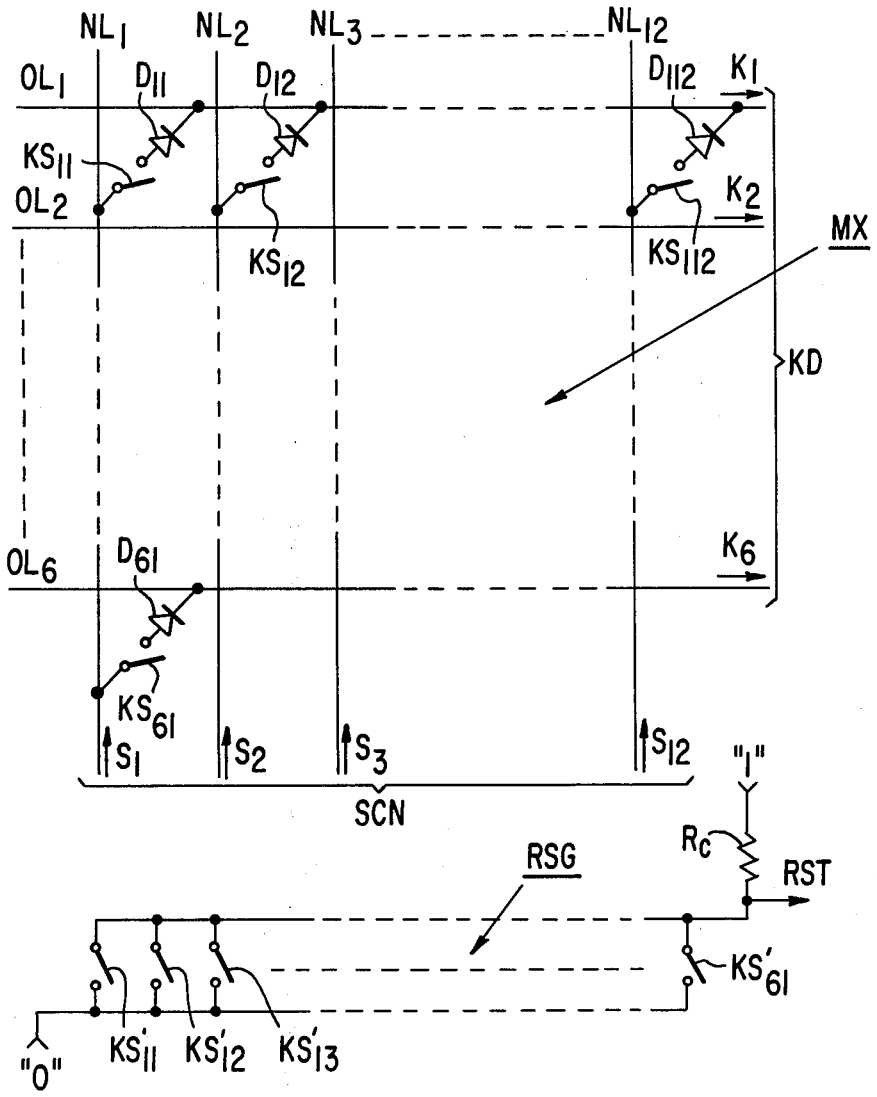
FIG. 2 is a circuit incorporated in the system shown in FIG. 1.

Referring now to FIG. 2, there is shown the detailed construction of the key switch circuit 10 shown in FIG. 1. The circuit 10 comprises a matrix circuit MX formed by the intersections of twelve note lines $NL_1$ to $NL_{12}$ and six octave lines $OL_1$ to $OL_6$, and a reset signal generator circuit RSG. In the matrix circuit MX, key switches $KS_{11}$ to $KS_{61}$ connected in series with diodes $D_{11}$ to $D_{61}$ are connected to almost all of the intersecting points, as shown in the drawing. As described hereinbefore, the illustrated electronic musical instrument is provided with sixty-one key switches KS as there are sixty-one keys. On the other hand, there are seventy-two ($6\times12$) intersecting points in the matrix, so that eleven intersecting points are left unconnected with the above mentioned circuit including serially connected key switch and diode.

The circuit RSG for generating the reset signal RST has, make contacts $KS'_{11}$ to $KS'_{61}$ which cooperate with respective key switches $KS_{11}$ to $KS_{61}$. One terminal of each of the make contacts $KS_{11}$ to $KS_{61}$ is connected to a signal source which is maintained at a logical "0", while the other terminal, thereof, is combined through a common resistance $R_c$ with a signal source which is maintained at a logical "1".

When one or a plurality of key switches is operated by the key 10*a* shown in FIG. 1 to be closed in the key switch circuit 10 mentioned above, each intersecting point of the matrix connected with the closed key switch is rendered conductive and a conductive passage is formed between the corresponding note line NL and the octave line OL. As described above, the scanning signals $S_1$ to $S_{12}$ (SCN) are fed from the key state detecting circuit 12 to respective note lines $NL_1$ to $NL_{12}$, one after another sequentially, so that the key data KD shown by $K_1$ to $K_6$ is obtained from the corresponding octave lines OL if the key switch KS of the notes in the corresponding octaves is closed. At the same time the reset signal RST, which is maintained at a logical "1" in the reset signal generator circuit RSG when the key is not depressed, becomes a logical "0" when the make contact KS corresponding to the closed key switch KS is closed. The reset signal RST taking the level "1" shows that no key is depressed (no key switch KS is closed), while the reset signal becoming a logical "0", shows that any of the keys are depressed (any of the key switches is closed).

Figure 3:
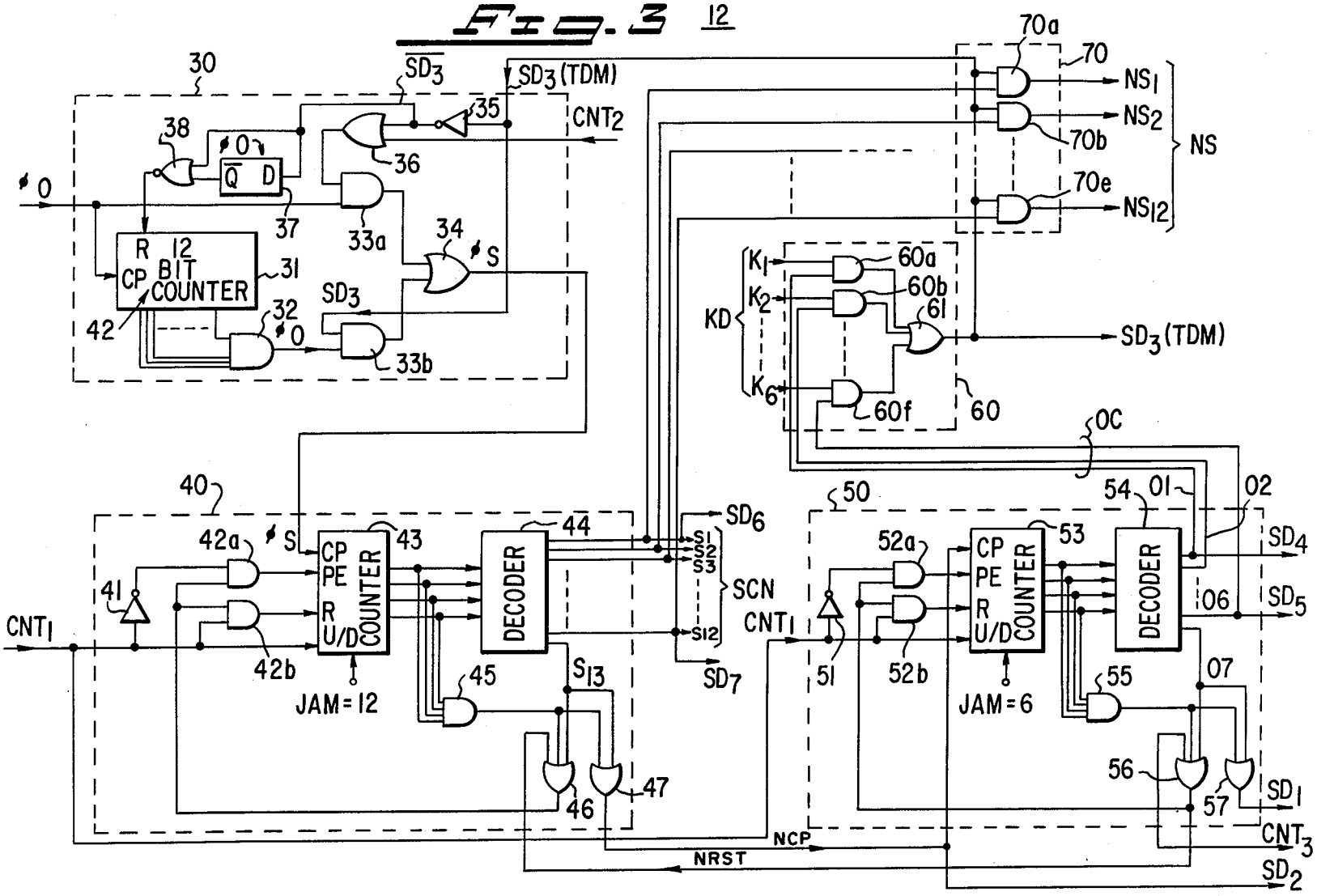
FIG. 3 is a logic circuit diagram showing the detail of the key state detecting circuit incorporated in the system shown in FIG. 1.

FIG. 3 shows the detail of the aforementioned key state detecting circuit 12. This circuit 12 comprises a clock select circuit 30, selecting either a high speed clock signal $\phi_0$ or a low speed clock signal $\phi_0'$ (which is obtained by dividing the frequency of said clock signal $\phi_0$) in response to the scanning data $SD_3$ composed of the time division multiplex signal (TDM) and the control signal $CNT_2$ which is fed from the circuit shown in FIG. 8 thereby delivering selected clock signal $\phi_s$. The circuit 12 further includes a note defining sequential pulse generating circuit 40 timed by the clock signal $\phi_s$ and controlled by the up-down control signal $CNT_1$ and the next stage resetting signal NRST and is for generating the scanning signal SCN composed of twelve sequential pulse trains $S_1$ to $S_{12}$. The circuit 12 also includes an octave defining sequential pulse generating circuit 50 timed by the next stage clock signal (NCP) and controlled by the up-down control signal $CNT_1$ and the reset signal $CNT_3$ and is for generating the octave defining sequential pulses OC which is composed of six sequential pulse trains $O_1$ to $O_6$. In addition, the circuit 12 includes time division multiplex signal generating circuit 60 which is fed with the key data KD and the octave defining sequential pulse signal OC and is for delivering scanning data $SD_3$ composed of the time division multiplex signals TDM. Also the circuit 12 includes a sounding note designating signal generator circuit 70 which is fed with the scanning signal SCN and the scanning data $SD_3$ and is for delivering a sounding note designating signal NS.

The clock select circuit 30 is provided with a twelve-bit counter 31 for receiving the clock signal $\phi_0$ at its clock input terminal CP and counting the same. The frequency of the clock signal is variable preferably within the range of 4 KHZ through 40 KHZ. Twelve-bit parallel output from the counter is received by an AND gate 32. The twelve-bit parallel output is varied in its state from the state in which all of its bits are at a logical "1", as the counter 31 counts up the clock signal $\phi_0$. Accordingly, the pulse repetition frequency of the AND output $\phi_0$ is 1/4096 or $1/2^{12}$ times as much as that of the clock signal $\phi_0$ and is variable preferably within the range of 1 Hz through 10 Hz. In this sense, the clock signal $\phi_0$ is referred to as a high speed clock signal, while the clock signal $\phi_0'$ is referred to as a low speed clock signal. The high speed clock signal $\phi_0$ and the low speed clock signal $\phi_0'$ are, respectively, fed to one of the input terminals of the two-input AND gates 33*a* and 33*b*. The other terminals of the AND gates 33*a* and 33*b* receive, respectively, the OR output of the OR gate 36 and the scanning data $SD_3$, i.e. the time division multiplex signals TDM. The OR gate 34 receives outputs of the AND gates 33*a* and 33*b*, and puts out the selected clock signal $\phi_s$ which is formed by the combination of the high speed clock signal $\phi_0$ and the low speed clock signal $\phi_0'$. As is described in detail hereinafter, the time division multiple signals TDM take the logical "1" level in synchronism with the octave defining sequential pulse OC which takes the logical "1" level when any of the key data KD from any of the octave lines OL takes the logical "1" level, i.e., when any key within the corresponding octave, is depressed. The signal $SD_3$ composed of the signals TDM which are fed to the AND gate 33*b*, and is fed to the AND gate 33*a* through an inverter 35 and the OR gate 36. The control signal $CNT_2$, which becomes a logical "1" when the circuit, shown in FIG. 8, temporarily performs an up-mode operation during down-mode condition, is applied to the remaining input of the OR gate 36. Thus, the high speed clock signal $\phi_0$ is selected to form the selected clock signal $\phi_s$ when the signal $SD_3$ becomes a logical "0" or the signal $CNT_2$ becomes a logical "1". On the contrary, the low speed clock signal $\phi_0'$ is selected to form the selected clock signal $\phi_s$ when the signal $SD_3$ becomes logical "1". The circuit including a D-flip-flop 37 for receiving the outputs $\overline{SD_3}$ of the inverter 35 and timed by the clock signal $\phi_0$ and an NOR gate 38 for receiving the input D and the output $\overline{Q}$ of the flip-flop delivers the NOR output composed of a reset pulse having a width corresponding to one clock pulse of the signal $\phi_0$ to the reset input terminal R of the counter 31, when the signals $\overline{SD_3}$ applied to the input D of the flip-flop transit to the logical "0" level, i.e., the signals $SD_3$ transit to the logical "1" level. When the counter 31 receives the above mentioned reset pulse, all of its bits are reset at the level "1". As a result, the low speed clock signal $\phi_0$ is taken out in synchronism with the time division multiplex signals $SD_3$ (TDM).

The main elements of the note defining sequential pulse generator circuit 40 include a four-bit up-down counter 43 for counting the selected clock signal $\phi_s$, and a decoder 44 for delivering out twelve sequential pulse trains $S_1$ to $S_{12}$ corresponding to twelve notes by decoding the four-bit parallel output of the counter 43. The counter 43, which receives the selected clock signal $\phi_s$ at its clock input terminal CP is a jam preset type counter. The preset number at the jam terminal JAM is 12. The up-down control signal $CNT_1$ is directly applied to the mode indicating input terminal U/D of the counter 43, and further applied to the preset-enable input terminal PE via the inverter 41 and the AND gate 42*a*. Four input terminals of the AND gate 45 for detecting that the output of the counter reaches the maximum value 16 are respectively connected to four output terminals of the counter 43, while the outputs of the gate 45 are fed to the other input terminals of the OR gates 46 and 47, one input terminal of which is adapted to be fed with the thirteenth output $S_{13}$ of the decoder 44. The remaining input terminal of the three-input OR gate 46 receives the next stage reset signal NRST from the octave defining sequential pulse generator circuit 50, the detail of which will be described hereinafter. The output of the OR gate 47 is fed to the sequential pulse generator circuit 50 as the next stage clock signal NCP. The output of the OR gate 46 is, on the one hand, applied to the second input terminal of the AND gate 42*a*, and on the other hand, applied to the first input terminal of the AND gate 42*b*. To the second input terminal of the AND gate 42*b* is fed the control signal $CNT_1$, so that the logical product of the output of the OR gate 46 and the control signal $CNT_1$ is applied to the reset input terminal R of the counter 43. The control signal $CNT_1$ becoming a logical "0", indicated the down-count mode operation, while becoming a logical "1" indicates the up-count mode operation. In the meanwhile, the sequential pulse trains $S_1$ and $S_2$ are, respectively, fed also to the circuit shown in FIG. 8 as the scanning data $SD_6$ and $SD_7$.

The construction of the octave defining sequential pulse generator circuit 50 is similar as that of the above mentioned circuit 40, and includes a four-bit up-down counter 53 for counting the next stage clock signal NCP and a decoder 54 for decoding the four-bit parallel output to generate the octave defining sequential pulse signal OC composed of six sequential pulse trains $O_1$ to $O_6$ corresponding respectively to six octaves. The control signal $CNT_1$ is applied to the mode indicating input terminal U/D of the counter 53, while the JAM=6 is preset at the jam terminal. The seventh output $0_7$ of the decoder 54 is applied respectively to the first input terminals of the OR gates 56 and 57, while the output of the four-input AND gate 55 for receiving the output of the four-bit parallel output of the counter 53 and for detecting the maximum value (16) is fed to the second input terminal of the OR gate 56 fed is the reset signal $CNT_3$ from the circuit shown in FIG. 8. The scanning data $SD_1$ composed of the outputs from the AND gate 57 are fed to the circuit shown in FIG. 8. Further fed to the circuit shown in FIG. 8 are the scanning data $SD_2$ composed of the next stage clock signal NCP and the scanning data $SD_4$ and $SD_5$, respectively, composed of the sequential pulse trains $0_1$ and $0_6$. The output from the OR gate 56 is, on the one hand, fed to the first input terminals of the AND gates 52*a* and 52*b*, and on the other hand, fed to the note defining sequential pulse generator circuit 40 to form the next stage reset signal NRST. To the second input terminals of the AND gates 52*a*, and 52*b* fed, respectively, are the output from the inverter 51 which receives the control signal $CNT_1$ and the control signal $CNT_1$ and the outputs from respective gates 52*a* and 52*b* are fed to the preset enable input terminal PE and the reset input terminal R of the counter 53.

The octave defining sequential pulse generator circuit 60, which receives the key data KD obtained from the octave lines OL as a result of scanning operation on the key switch group as previously described with reference to FIG. 1 and which also receives the octave defining sequential pulse signal OC put out from the aforementioned octave defining sequential pulse generator circuit 50, includes six AND gates 60*a* to 60*f* each being applied with a corresponding pair of inputs $K_1$-$O_1$, $K_2$-$O_2$, . . . , $K_6$ -$O_6$in accordance with respective octaves and a six-input OR gate 61 for performing OR operation on the outputs from the AND gates 60*a* to 60*f* to, thereby, generate the scanning data $SD_3$ composed of time division multiplex signals TDM. The scanning data is fed respectively, to the clock select circuit 30, to the sounding note designating signal generator circuit 70 and to the circuit shown in FIG. 8.

The sounding note designating signal generator circuit 70 includes twelve AND gates 70*a* to 70*e* which respectively perform AND operations of the scanning signals $S_1$ to $S_{12}$ with the time division multiplex signals TDM. The generator circuit 70 is adapted to put out the sounding note designating signals $NS_1$ to $NS_{12}$ (NS) from the output terminals of the AND gates 70*a* to 70*e* to the circuits shown in FIGS. 9 and 11.

Figure 4:
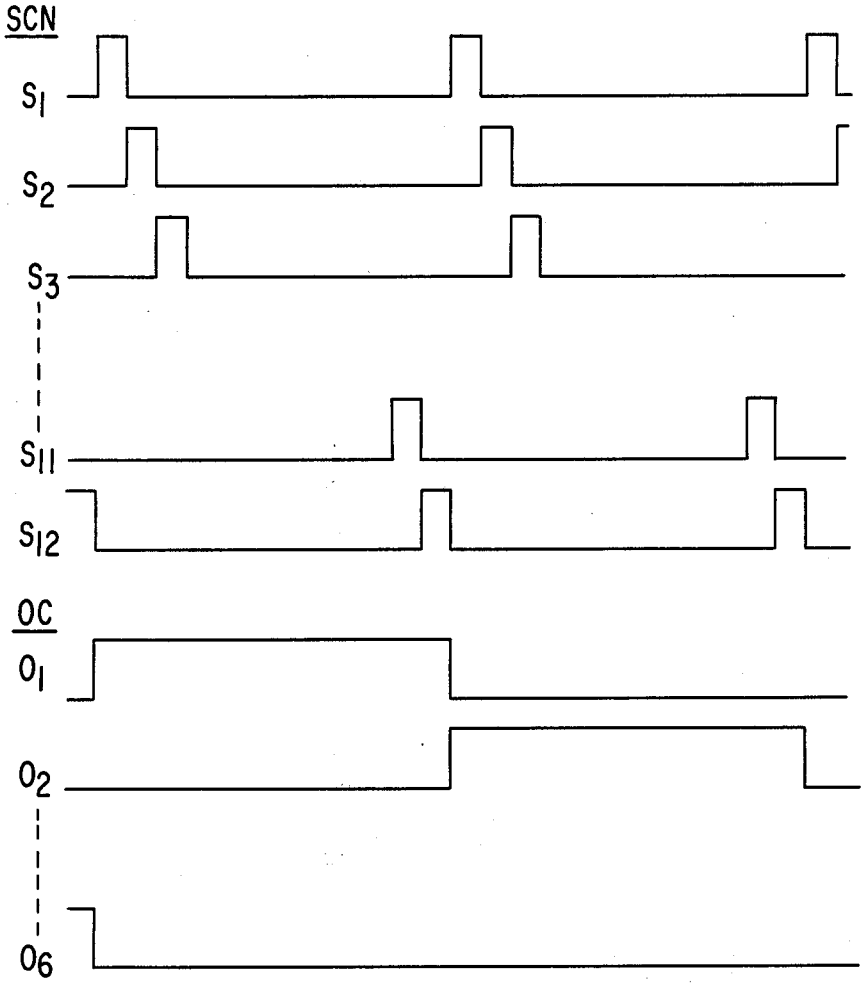
FIGS. 4, 5, 6, *7a*, *7b* and *7c* are time charts of signals for illustrating the operation of the circuit shown in FIG. 3.

The operation of the circuit shown in FIG. 3 and having the construction referred to above, will be briefly explained in the following description. In the initial undepressed state, under which the reset control signal $CNT_3$ becomes a logical "1" (it becomes a logical "1" when the reset signal RST becomes logical "1" as described hereinafter), the outputs from the AND gates 42*b* and 52*b* or the respectively, in response to whether the up-down control signal CNT becomes a logical "1" (up-mode) or a logical "0" (down-mode), and the counters 43 and 53 are in reset or preset-enable condition. In the reset condition, all output bits of the counters 43 and 53 become a logical "0", and the decoders 44 and 54 put out the outputs $S_1$ and $O_1$. On the other hand, decoders 44 and 54 put out the outputs $S_{12}$ and $O_6$ in the preset-enable condition, since the JAM=12 and JAM=6 are put in respective counters 43 and 53. These conditions are kept until any of the keys are depressed to close corresponding key switch KS thereby to allow the reset control signal $CNT_1$ to become a logical "0". Assuming now, that the level of the control signal $CNT_1$ is "1" to indicate the up-mode, sequential pulse trains $S_1$ to $S_{12}$ and $O_1$ to $O_6$ shown in FIG. 4 are generated respectively from the outputs of the decoders 44 and 54. The pulse trains $S_1$ to $S_{12}$ form the scanning signal SCN, and the pulse trains $O_1$ to $O_6$ form the octave defining sequential pulse signal OC. Further reference will be made to the operation for generating such sequential pulses. At the first place, the counter 43 counts up the selected clock signal $\phi_S$ in up-mode to change its output from the state "0000" to the state "1111" in the note defining sequential pulse generator circuit 40. In response thereto, the output of the decoder 44 successively shifts from $S_1$ to $S_{12}$. Finally, the thirteenth output $S_{13}$ is generated, this output is fed through the OR gate 46 and the AND gate 42*b* to reset all output bits of the counter 43 to "0". As a result, the counter 43 begins its counting-up operation again from the state "0000" accompanied with the generation of sequential outputs $S_1$ to $S_{12}$ by the decoder 44. Contrary to this up-mode operation, the counter 43 takes therein the JAM=12 and begins its counting-down operation from the timing when the output of the decoder 44 is $S_{12}$ under the down-mode condition wherein the control signal $CNT_1$ becomes a logical "0". After the decoder outputs shift sequentially from $S_{12}$ through $S_{11}$, $S_{10}$, . . . to $S_1$, all output bits of the counter 43 are changed from the "0" to "1" state and the output of the counter designates 16 when shown by decimal notation. The AND gate 45 is to detect the state wherein the counter 43 reaches its maximum value (16), and generates the logical "1" level output when all of the output bits of the counter become a logical "1". This logical "1" level output is fed through the OR gate 46 and the AND gate 42*a* to bring the counter 43 in the preset-enable state. At this time, the counter takes therein the JAM=12 again and begins to its counting-down operation from the state similar as the initial state (the state under which the decoder 44 generates the output $S_{12}$). It should be apparent from the foregoing descriptions that the outputs $S_1$ to $S_{12}$ shown in FIG. 4 are produced in order starting from the $S_{12}$ and directing to $S_1$.

Accompanying with the up- or down-mode operation of the note defining sequential pulse per generation of twelve pulses is fed through the OR gate 47 to the octave defining sequential pulse generator circuit 50 forming the next stage clock signal NCP. The circuit 50 has a construction similar to that of the aforementioned circuit 40, and thus, operates in a similar manner. Namely, in the up- or down-mode operation instructed by the control signal $CNT_1$, the clock signals NCP are counted up or counted down, and the decoder decodes the parallel outputs from the counter 53 to produce the sequential pulse trains as shown by $O_1$ to $O_6$ in FIG. 4. FIG. 4 shows the outputs $O_1$ to $O_6$ in the up-mode operation, while in the down-mode operation the outputs starting from $O_6$ and directing to $O_1$ are produced. More detailed description of the operation of the sequential pulse generator circuit 50 will be omitted, since it is considered that the operation of the circuit 50 may be easily understood from that of the said sequential pulse generator circuit 40.

Figure 5:
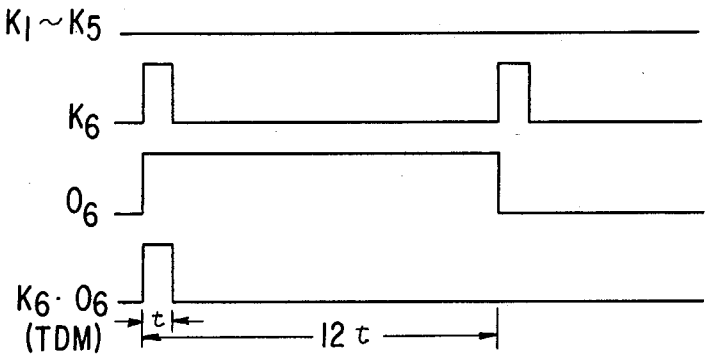

FIG. 5 shows one example of generating time division multiplex signal TDM, assuming that the scanning is carried out in a constant time interval, for ease of understanding. In operation, the time division multiplex signal generator circuit 60, the key data KD wherein the data $K_1$ to $K_5$ became a logical "0" and the datum $K_6$ becomes a logical "1", as shown in FIG. 5, is a result of the scanning operation by the aforementioned scanning signal SCN on the key switches. The illustrated key data shown is that one of the key switches KS, which is connected to the octave line $OL_6$, is closed. The key datum $K_6$ is subjected to an AND operation with the octave defining sequential pulse train $O_6$ by the and controlled by the up-down control signal $CNT_1$ and the next stage resetting signal NRST and is for generating the scanning signal SCN composed of twelve sequential pulse trains $S_1$ to $S_{12}$. The circuit 12 also includes an octave defining sequential pulse generating circuit 50 timed by the next stage clock signal (NCP) and controlled by the up-down control signal $CNT_1$ and the reset signal $CNT_3$ and is for generating the octave defining sequential pulses OC which is composed of six sequential pulse trains $O_1$ to $O_6$. In addition, the circuit 12 includes time division multiplex signal generating circuit 60 which is fed with the key data KD and the octave defining sequential pulse signal OC and is for delivering scanning data $SD_3$ composed of the time division multiplex signals TDM. Also the circuit 12 includes a sounding note designating signal generator circuit 70 which is fed with the scanning signal SCN and the scanning data $SD_3$ and is for delivering a sounding note designating signal NS.

The clock select circuit 30 is provided with a twelve-bit counter 31 for receiving the clock signal $\phi_0$ at its clock input terminal CP and counting the same. The frequency of the clock signal is variable preferably within the range of 4 KHZ through 40 KHZ. Twelve-bit parallel output from the counter is received by an AND gate 32. The twelve-bit parallel output is varied in its state from the state in which all of its bits are at a logical "1", as the counter 31 counts up the clock signal $\phi_0$. Accordingly, the pulse repetition frequency of the AND output $\phi_0$ is 1/4096 or $1/2^{12}$ times as much as that of the clock signal $\phi_0$ and is variable preferably within the range of 1 Hz through 10 Hz. In this sense, the clock signal $\phi_0$ is referred to as a high speed clock signal, while the clock signal $\phi_0'$ is referred to as a low speed clock signal. The high speed clock signal $\phi_0$ and the low speed clock signal $\phi_0'$ are, respectively, fed to one of the input terminals of the two-input AND gates **33*a* and 33*b*. The other terminals of the AND gates 33*a* and 33*b* receive, respectively, the OR output of the OR gate 36 and the scanning data $SD_3$, i.e. the time division multiplex signals TDM. The OR gate 34 receives outputs of the AND gates 33*a* and 33*b*, and puts out the selected clock signal $\phi_s$ which is formed by the combination of the high speed clock signal $\phi_0$ and the low speed clock signal $\phi_0'$. As is described in detail hereinafter, the time division multiple signals TDM take the logical "1" level in synchronism with the octave defining sequential pulse OC which takes the logical "1" level when any of the key data KD from any of the octave lines OL takes the logical "1" level, i.e., when any key within the corresponding octave, is depressed. The signal $SD_3$ composed of the signals TDM which are fed to the AND gate 33*b*, and is fed to the AND gate 33*a* through an inverter 35 and the OR gate 36. The control signal $CNT_2$, which becomes a logical "1" when the circuit, shown in FIG. 8, temporarily performs an up-mode operation during down-mode condition, is applied to the remaining input of the OR gate 36. Thus, the high speed clock signal $\phi_0$ is selected to form the selected clock signal $\phi_s$ when the signal $SD_3$ becomes a logical "0" or the signal $CNT_2$ becomes a logical "1". On the contrary, the low speed clock signal $\phi_0$ is selected to form the selected clock signal $\phi_s$ when the signal $SD_3$ becomes logical "1". The circuit including a D-flip-flop 37 for receiving the outputs $\overline{SD_3}$ of the inverter 35 and timed by the clock signal $\phi_0$ and an NOR gate 38 for receiving the input D and the output Q of the flip-flop delivers the NOR output composed of a reset pulse having a width corresponding to one clock pulse of the signal $\phi_0$ to the reset input terminal R of the counter 31, when the signals $\overline{SD_3}$ applied to the input D of the flip-flop transit to the logical "0" level, i.e., the signals $SD_3$ transit to the logical "1" level. When the counter 31** receives the above mentioned reset pulse, all of its bits are reset at the level "1". As a result, the low speed clock signal $\phi_0$ is taken out in synchronism with the time division multiplex signals $SD_3$ (TDM).

The main elements of the note defining sequential pulse generator circuit 40 include a four-bit up-down counter 43 for counting the selected clock signal $\phi_s$, and a decoder 44 for delivering out twelve sequential pulse trains $S_1$ to $S_{12}$ corresponding to twelve notes by decoding the four-bit parallel output of the counter 43. The counter 43, which receives the selected clock signal $\phi_s$ at its clock input terminal CP is a jam preset type counter. The preset number at the jam terminal JAM is 12. The up-down control signal $CNT_1$ is directly applied to the mode indicating input terminal U/D of the counter 43, and further applied to the preset-enable input terminal PE via the inverter 41 and the AND gate **42*a*. Four input terminals of the AND gate 45 for detecting that the output of the counter reaches the maximum value 16 are respectively connected to four output terminals of the counter 43, while the outputs of the gate 45 are fed to the other input terminals of the OR gates 46 and 47, one input terminal of which is adapted to be fed with the thirteenth output $S_{13}$ of the decoder 44. The remaining input terminal of the three-input OR gate 46 receives the next stage reset signal NRST from the octave defining sequential pulse generator circuit 50, the detail of which will be described hereinafter. The output of the OR gate 47 is fed to the sequential pulse generator circuit 50 as the next stage clock signal NCP. The output of the OR gate 46 is, on the one hand, applied to the second input terminal of the AND gate 42*a*, and on the other hand, applied to the first input terminal of the AND gate 42*b*. To the second input terminal of the AND gate 42*b* is fed the control signal $CNT_1$, so that the logical product of the output of the OR gate 46 and the control signal $CNT_1$ is applied to the reset input terminal R of the counter 43. The control signal $CNT_1$ becoming a logical "0", indicated the down-count mode operation, while becoming a logical "1" indicates the up-count mode operation. In the meanwhile, the sequential pulse trains $S_1$ and $S_2$ are, respectively, fed also to the circuit shown in FIG. 8** as the scanning data $SD_6$ and $SD_7$.

The construction of the octave defining sequential pulse generator circuit 50 is similar as that of the above mentioned circuit 40, and includes a four-bit up-down counter 53 for counting the next stage clock signal NCP and a decoder 54 for decoding the four-bit parallel output to generate the octave defining sequential pulse signal OC composed of six sequential pulse trains $O_1$ to $O_6$ corresponding respectively to six octaves. The control signal $CNT_1$ is applied to the mode indicating input terminal U/D of the counter 53, while the JAM=6 is preset at the jam terminal. The seventh output $O_7$ of the decoder 54 is applied respectively to the first input terminals of the OR gates 56 and 57, while the output of the four-input AND gate 55 for receiving the output of the four-bit parallel output of the counter 53 and for detecting the maximum value (16) is fed to the second input terminal of the OR gate 56 fed is the reset signal $CNT_3$ from the circuit shown in FIG. 8. The scanning data $SD_1$ composed of the outputs from the AND gate 57 are fed to the circuit shown in FIG. 8. Further fed to the circuit shown in FIG. 8 are the scanning data $SD_2$ composed of the next stage clock signal NCP and the scanning data $SD_4$ and $SD_5$, respectively, composed of the sequential pulse trains $0_1$ and $0_6$. The output from the OR gate 56 is, on the one hand, fed to the first input terminals of the AND gates 52*a* and 52*b*, and on the other hand, fed to the note defining sequential pulse generator circuit 40 to form the next stage reset signal NRST. To the second input terminals of the AND gates 52*a*, and 52*b* fed, respectively, are the output from the inverter 51 which receives the control signal $CNT_1$ and the control signal $CNT_1$ and the outputs from respective gates 52*a* and 52*b* are fed to the preset enable input terminal PE and the reset input terminal R of the counter 53.

The octave defining sequential pulse generator circuit 60, which receives the key data KD obtained from the octave lines OL as a result of scanning operation on the key switch group as previously described with reference to FIG. 1 and which also receives the octave defining sequential pulse signal OC put out from the aforementioned octave defining sequential pulse generator circuit 50, includes six AND gates 60*a* to 60*f* each being applied with a corresponding pair of inputs $K_1$-$O_1$, $K_2$-$O_2$, . . . , $K_6$-$O_6$in accordance with respective octaves and a six-input OR gate 61 for performing OR operation on the outputs from the AND gates 60*a* to 60*f* to, thereby, generate the scanning data $SD_3$ composed of time division multiplex signals TDM. The scanning data is fed respectively, to the clock select circuit 30, to the sounding note designating signal generator circuit 70 and to the circuit shown in FIG. 8.

The sounding note designating signal generator circuit 70 includes twelve AND gates 70*a* to 70*e* which respectively perform AND operations of the scanning signals $S_1$ to $S_{12}$ with the time division multiplex signals TDM. The generator circuit 70 is adapted to put out the sounding note designating signals $NS_1$ to $NS_{12}$ (NS) from the output terminals of the AND gates 70*a* to 70*e* to the circuits shown in FIGS. 9 and 11.

The operation of the circuit shown in FIG. 3 and having the construction referred to above, will be briefly explained in the following description. In the initial undepressed state, under which the reset control signal $CNT_3$ becomes a logical "1" (it becomes a logical "1" when the reset signal RST becomes logical "1" as described hereinafter), the outputs from the AND gates 42*b* and 52*b* or the respectively, in response to whether the up-down control signal CNT becomes a logical "1" (up-mode) or a logical "0" (down-mode), and the counters 43 and 53 are in reset or preset-enable condition. In the reset condition, all output bits of the counters 43 and 53 become a logical "0", and the decoders 44 and 54 put out the outputs $S_1$ and $O_1$. On the other hand, decoders 44 and 54 put out the outputs $S_{12}$ and $O_6$ in the preset-enable condition, since the JAM=12 and JAM=6 are put in respective counters 43 and 53. These conditions are kept until any of the keys are depressed to close corresponding key switch KS thereby to allow the reset control signal $CNT_1$ to become a logical "0". Assuming now, that the level of the control signal $CNT_1$ is "1" to indicate the up-mode, sequential pulse trains $S_1$ to $S_{12}$ and $O_1$ to $O_6$ shown in FIG. 4 are generated respectively from the outputs of the decoders 44 and 54. The pulse trains $S_1$ to $S_{12}$ form the scanning signal SCN, and the pulse trains $O_1$ to $O_6$ form the octave defining sequential pulse signal OC. Further reference will be made to the operation for generating such sequential pulses. At the first place, the counter 43 counts up the selected clock signal $\phi_S$ in up-mode to change its output from the state "0000" to the state "1111" in the note defining sequential pulse generator circuit 40. In response thereto, the output of the decoder 44 successively shifts from $S_1$ to $S_{12}$. Finally, the thirteenth output $S_{13}$ is generated, this output is fed through the OR gate 46 and the AND gate 42*b* to reset all output bits of the counter 43 to "0". As a result, the counter 43 begins its counting-up operation again from the state "0000" accompanied with the generation of sequential outputs $S_1$ to $S_{12}$ by the decoder 44. Contrary to this up-mode operation, the counter 43 takes therein the JAM=12 and begins its counting-down operation from the timing when the output of the decoder 44 is $S_{12}$ under the down-mode condition wherein the control signal $CNT_1$ becomes a logical "0". After the decoder outputs shift sequentially from $S_{12}$ through $S_{11}$, $S_{10}$, . . . to $S_1$, all output bits of the counter 43 are changed from the "0" to "1" state and the output of the counter designates 16 when shown by decimal notation. The AND gate 45 is to detect the state wherein the counter 43 reaches its maximum value (16), and generates the logical "1" level output when all of the output bits of the counter become a logical "1". This logical "1" level output is fed through the OR gate 46 and the AND gate 42*a* to bring the counter 43 in the preset-enable state. At this time, the counter takes therein the JAM=12 again and begins to its counting-down operation from the state similar as the initial state (the state under which the decoder 44 generates the output $S_{12}$). It should be apparent from the foregoing descriptions that the outputs $S_1$ to $S_{12}$ shown in FIG. 4 are produced in order starting from the $S_{12}$ and directing to $S_1$.

Accompanying with the up- or down-mode operation of the note defining sequential pulse per generation of twelve pulses is fed through the OR gate 47 to the octave defining sequential pulse generator circuit 50 forming the next stage clock signal NCP. The circuit 50 has a construction similar to that of the aforementioned circuit 40, and thus, operates in a similar manner. Namely, in the up- or down-mode operation instructed by the control signal $CNT_1$, the clock signals NCP are counted up or counted down, and the decoder decodes the parallel outputs from the counter 53 to produce the sequential pulse trains as shown by $O_1$ to $O_6$ in FIG. 4. FIG. 4 shows the outputs $O_1$ to $O_6$ in the up-mode operation, while in the down-mode operation the outputs starting from $O_6$ and directing to $O_1$ are produced. More detailed description of the operation of the sequential pulse generator circuit 50 will be omitted, since it is considered that the operation of the circuit 50 may be easily understood from that of the said sequential pulse generator circuit 40.

Figure 6:
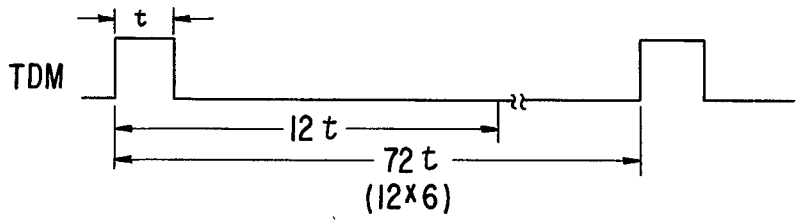
Figure 7A:
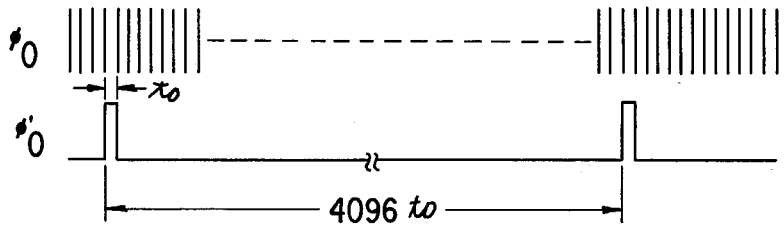
Figure 7B:
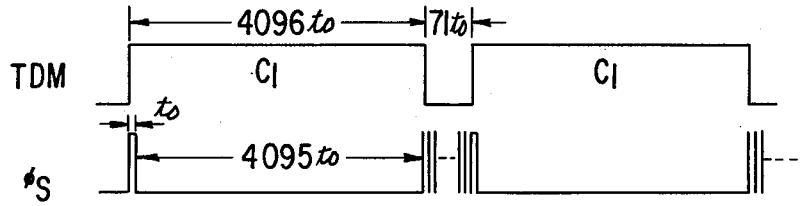
Figure 7C:
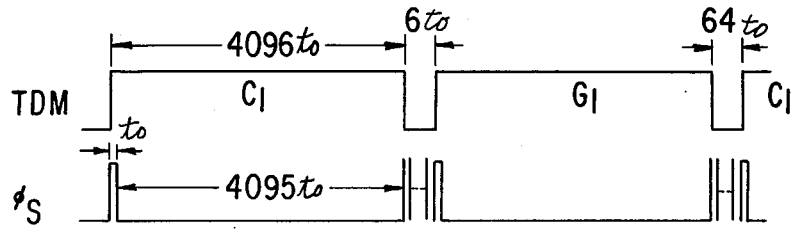
Figure 14:
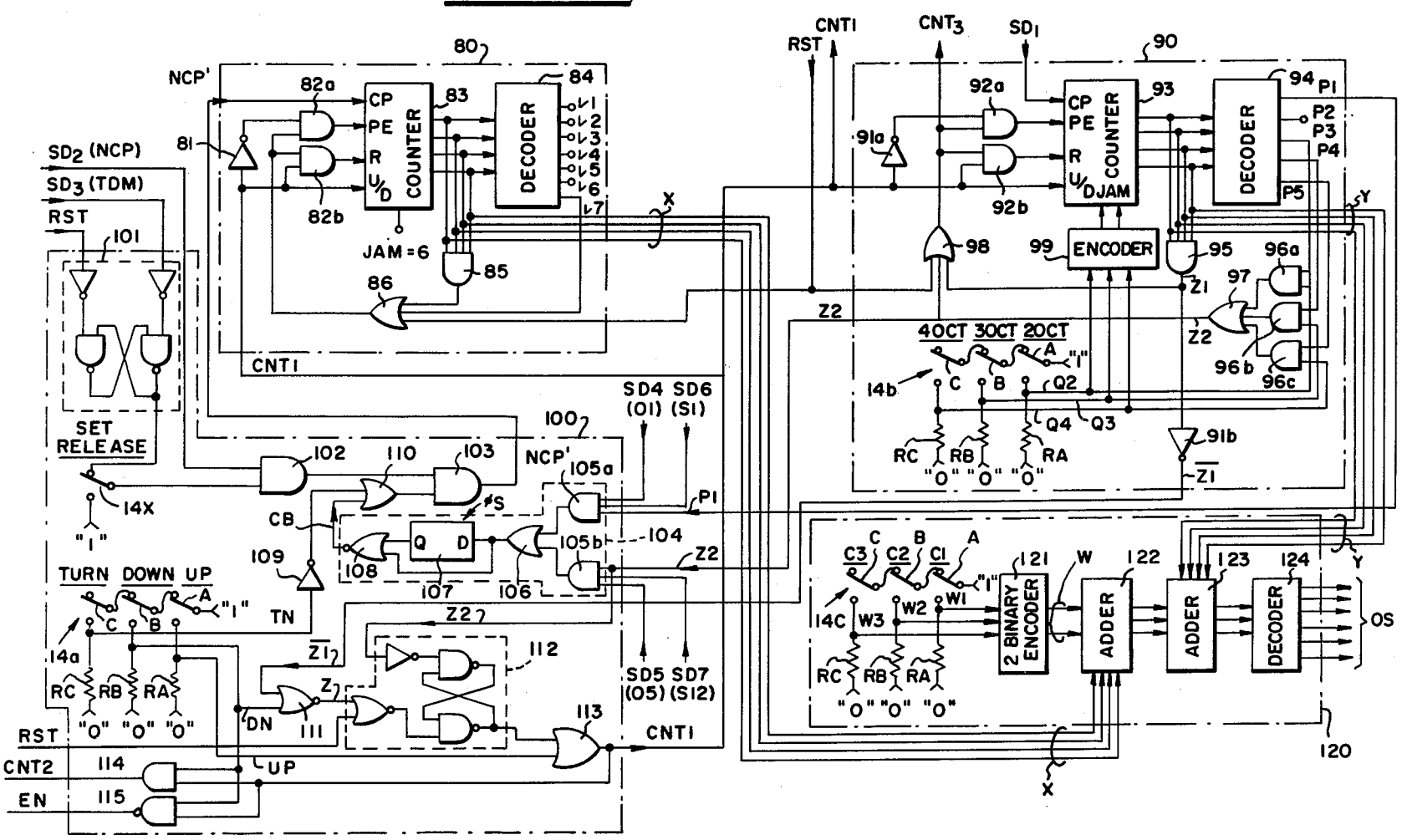

FIG. 5 shows one example of generating time division multiplex signal TDM, assuming that the scanning is carried out in a constant time interval, for ease of understanding. In operation, the time division multiplex signal generator circuit 60, the key data KD wherein the data $K_1$ to $K_5$ became a logical "0" and the datum $K_6$ becomes a logical "1", as shown in FIG. 5, is a result of the scanning operation by the aforementioned scanning signal SCN on the key switches. The illustrated key data shown is that one of the key switches KS, which is connected to the octave line $OL_6$, is closed. The key datum $K_6$ is subjected to an AND operation with the octave defining sequential pulse train $O_6$ by the AND gate 60*f* in the circuit 60 to be outputted via the OR gate 61 to form a time division multiplex signal TDM as shown in FIG. 5. This signal TDM has, as shown in FIG. 6 in an enlarged scale being differentiated in its calibrated time standard, twelve time slots in one octave scanning period and thus has seventy-two (12×6) time slots within all of the six scanned octaves. The symbol T in the drawing shows the width of one pulse included in the sequential pulse train. The wave shapes of the pulses shown in FIGS. 4 and 5, and the wave shape of TDM shown in FIG. 6 are exemplarily illustrated, with the purpose of explanation, and have shapes which would appear when the sequential pulse generator circuits 40 and 50 were timed at a single constant rate by means of relatively low speed clock. Practically, these circuits are timed by the signals obtained by selectively combining the high speed clock signal $\phi_O$ and the low speed clock signal $\phi_O$ shown in FIG. 7*a* in the clock select circuit 30, i.e., at two different time intervals for the abovementioned single T. If the period of the high speed clock signal $\phi_O$ be $t_O$, the low speed clock signal $\phi_O$ has the period of 4096 t because the signal $\phi_O$ is the frequency division output from the twelve-bit counter 31 to have the frequency of 1/4096 times as many as that of the signal $\phi_O$. Either of these clock signals $\phi_O$ or $\phi_O$ is selected such that the high speed clock signal $\phi_O$ is outputted from the clock select circuit 30 when the scanning data $SD_3$ composed of the time division multiplex signals TDM became a logical "0" or the control signal $CNT_2$ becomes a logical "1", and that the low speed clock signal $\phi_O$ is outputted from the circuit 30 when the signals $SD_3$ becomes logical "1". In other words, in scanning operation, if the signal $SD_3$ indicates by their logical "1" levels to show that the key is depressed, the low speed clock signal $\phi_O$ is selected in synchronism with the striking operation; while the high speed clock signal $\phi_O$ is selected when the signals $SD_3$ indicates by their logical "0" level to show that no key is depressed or in special case when the control signal $CNT_2$ indicates by its logical "1" level to show that a temporary up-mode operation is performed during the down-mode operation. The high speed clock signal $\phi_O$ or the low speed clock signal $\phi_O$ is selectively used in the manner mentioned above, since it is required to produce tha musical tone corresponding to the depressed key for a certain period of time when the scanning data $SD_3$ indicates that the key is depressed. The period of 4096 $t_O$ shown in FIG. 7*a* always runs at minimum from the time of generation of certain musical tone to the time of generation of the subsequent musical tone. FIGS. 7*b* and 7*c* show, respectively, the practically generated time division multiplex signals TDM and the selected clock signals $\phi_S$ in cases when only the key of the note $C_1$ is depressed and when two keys of the notes $C_1$ and $G_1$ are depressed.

As is described above, the time dicision multiplex signals are subjected to AND operations with respective note defining sequential pulse trains $S_1$ to $S_{12}$ in the sounding note designating signal generator circuit 70 to form the signals $NS_1$ to $NS_{12}$ which designate the note to be sounded. For instance, if the key corresponding to the note $C_1$ is depressed as described above, the output $NS_1$ from the AND gate 70*a* becomes a logical "1" thereby to indicate that the tone C shall be sounded. It should be appreciated that the octaves to be sounded are not indicated by the same signal.

The construction and operation of the sounding octave determining circuit 14 will be described in detail with reference to FIG. 8. The circuit 14 comprises a scanned octave counting circuit 80, a scanned cycle counting circuit 90, an operation mode setting circuit 100 and a sounding octave indicating signal generator circuit 120. Outputs X and Y are outputted respectively from the scanned octave counting circuit 80 and the scanned cycle counting 90 both being controlled by the up-down control signal CNT generated from the operation mode setting circuit 100 and are fed to the sounding octave indicating signal generator circuit 120 for defining the octaves to be sounded. An operation mode setting switch 14*a* for indicating the up-, down- or turn-mode is incorporated into the operation mode setting circuit 100, and a switch 14*x* for releasing the set limit of sounding octaves is also incorporated into the circuit 100. The switch 14*b* incorporated into the scanned cycle counting circuit 90 serves to set the width of the octaves to be sounded as two octaves (2 OCT), three octaves (3 OCT), four octaves (4 OCT) and so on. The switch 14*c* incorporated into the sounding octave indicating signal generator circuit 120 serves to set the limit of the sounding octave to the first octave including the tone $C_1$, the second octave including the tone $C_2$, the third octave including the tone $C_3$, and so on.

The construction of the scanned octave counting sequential pulse generator circuit 50, and includes a four-bit up-down counter 83 in which the JAM=6 is preliminarily set, and a decoder 84 for decoding the four-bit parallel outputs from the decoder 83. A four-input AND gate 85 is provided for detecting the maximum value of the output from the counter 83, and the AND output thereof is fed to the first input terminal of the three-input OR gate 86. To the second and third input terminals of the OR gate 86 is applied, respectively, the seventh output $V_7$ included in the outputs $V_1$ to $V_7$ from the decoder 84 and the reset signal RST generated from the circuit shown in FIG. 2. The OR output from the OR gate 86 is, on the one hand, fed through the AND gate 82*a* to the preset enable input terminal PE of the counter 83, and on the other hand fed through the AND gate 82*b* to the reset input terminal R of the counter. The up-down control signal $CNT_1$ is directly applied to the mode indicating input terminal U/D and the AND gate 82*b*, and indirectly applied to the AND gate 82*a* through the inverter 81. The counter 83 counts the scanning data $SD_2$, i.e., the clock signals NCP which correspond to the next stage clock signals NCP, in the up- or down-mode operation. In up-mode operation, the counter 83 is reset when the output of the decoder reaches $V_7$ through $V_1$ to $V_6$ and begins its counting-up operation again. While in down-mode operation, it begins its counting-down operation from the condition in which the decoder outputs the output $V_6$ and when the AND gate 85 detects the maximum value after the output from the decoder reaches $V_1$ the counter 83 is brought in the preset-enable condition to take therein the JAM=6. As a result, the counter 83 begins its counting-down operation of the outputs from the decoder starting from $V_6$ to $V_1$. As described above, one next stage clock signal NCP is produced per twelve sequential pulses, so that the counted output X obtained by counting the signals NCP indicates the number of the scanned octaves. As will be described hereinafter, the switch 14*x* in the illustrated embodiment serves to control the system so as to not only determine whether it performs up-, down- or turn-mode operation but also determine whether any of the aforementioned operation modes be initiated from or terminated at the depressed key location or the operation mode be initiated from or terminated at the limit location which has been predetermined independently of the key depression. Consequently, as will be described hereinafter, the control manner, in which the operation mode setting circuit 100 controls the next stage clock signal NCP, determines whether the counter 83 starts counting from the first pulse which indicates the first scanned octave or it starts counting from the pulse of the given number. (In the latter mentioned case, the octave indicated by said pulse of the given number is the first or minimum octave counted by the counter 83).

The scanned cycle counting circuit 90 which is an important circuit for understanding the present invention will now be described. The circuit 90 includes a four-bit up-down counter 93 to which changed JAM inputs are applied responsive to the outputs from the decoder 99 and a decoder 94 for decoding the four-bit parallel outputs includes three switching elements which are preferentially connected for enabling to prefrentially set only one of the octave widths 2 OCT, 3 OCT or 4 OCT shown in the drawing. The movable contact A is connected to the signal source of "1" level, and the movable contact C is combined with the contact A through the movable contact B. The fixed contacts which come in contact with or separated from these movable contacts A, B and C are connected through corresponding resistances $R_A$, $R_B$ and $R_C$ to the signal sources of "0" level, through which the sounding octave indicating signals $Q_2$, $Q_3$ and $Q_4$ are picked out of respective switching elements. The indicating signals $Q_2$, $Q_3$ and $Q_4$ are, on the one hand, put into the encoder 99 to be encoded, and on the other hand, applied respectively to two-input AND gates 96*a*, 96*b* and 96*c* to be subjected to AND operations with the third, fourth and fifth outputs $P_3$, $P_4$ and $P_5$ from the decoder 94. The outputs from the AND gates 96*a*, 96*b* and 96*c* are fed to the three-input OR gate 97, and the OR output $Z_2$ therefrom is, on the one hand, applied to the OR gate 98, and on the other hand fed to the operation mode setting circuit 100. The OR gate 98 further receives the output $Z_1$ from the four-input AND gate 95 when it receives the reset signal RST, and outputs the reset control signal $CNT_3$. The reset control signal $CNT_3$ is fed to the circuit described hereinabove with reference to FIG. 3, and further applied via the AND gates 92*a* and 92*b* respectively, to the preset-enable input terminal PE and to the reset input terminal R of the counter 93. The up-down control signal $CNT_1$, which is applied to the mode indicating input terminal U/D of the counter 93, is on the one hand, applied directly to the remaining input terminal of the AND gate 92*b*. The clock input terminal CP of the counter 93 are pit-in with the scanning data $SD_1$ which are composed of pulses generated one by one as the aforementioned octave defining sequential pulse generator circuit 50 generates the pulse trains $O_1$ to $O_6$ for all of the six octaves, i.e., as the scanning on all keys is completed. The output $Z_1$ from the AND gate 95 for detecting the maximum value of the four-bit parallel outputs from the counter 93 is delivered through the inverter 91*b* to the operation mode setting circuit 100. The four-bit parallel outputs Y from the counter 93 is fed to the sounding octave indicating signal generator circuit 120. The output $P_2$ from the decoder is not fed to any member, but the output $P_1$ is fed to the operation mode setting circuit 100.

When one of the movable contacts, for example the movable contact A, of the sounding octave width setting switch 14*b* is closed to allow the sounding octave width set signal $Q_2$ to take the level "1", the output from the encoder 99 and hence the JAM is brought to have the value 2, and the counter 93 performs the counting-up or counting-down operation so as to allow the decoder 94 of repeatedly putting out its outputs in the order of from $P_1$ to $P_2$ (in the up-mode operation) or in the order of from $P_2$ to $P_1$ (in the down-mode operation). The counting-up or counting-down operation by the counter 93 when the JAM input is predetermined as described before, it similar to the operation by the counters 43, 53 and 83, and thus may be readily analogized therefrom. For this reason, the operation of the counter 93 is not described in detail here. Eventually, the up-down counter 93 counts the scanning frequency which indicates the number of pulses contained in the scanning data SD in the mode indicated by the control signal CNT with the octave width set by the switch 14*b*. The counter 93 then outputs the binary signal Y which indicates, for instance, 0 and 1 successively if the predetermined width of octave to be sounded, is 2. Similarly, if the width of octave to be sounded is 3 or 4, the output binary signals Y are, respectively, composed of successively designated numbers 0, 1 and 2 or 0, 1, 2 and 3.

The operation mode setting circuit 100 will now be described. The circuit 100 includes, other than aforementioned switches 14*a* and 14*x*, an R-S flip-flop 101 for retaining the time division multiplex signals, clock select gates 102 and 103, a circuit 104 for generating a counting blocking signal, a flip-flop 112 for holding the down-mode indicating signal and for changing between the up- and down-mode, AND gate 114 for putting out the clock select control signal $CNT_2$, and a NAND gate 115 for outputting the enable signal EN. The R-S flip-flop 101 reset by the time division multiplex signals $SD_3$ (TDM) holds the level "1" at its output until it is reset by the reset signal RST generated by release of the key. Accordingly, the next stage clock signal $SD_2$ (NCP) is delivered through the AND gate 102 to the AND gate 103 as the output from the flip-flop 101 takes the level "1" when the movable contact of the sounding octave limit release switch 14*x* is in the illustrated condition (in the condition determining the limited sounding). On the contrary, if the movable contact of the switch 14*x* is closed to contact with the opposing fixed contact which is connected to the signal source of "1" level (in the condition under which the limit for sounding is released and wherein sounding of note is allowed to start from the depressed key location or to terminate at the depressed key location), the next stage clock signals NCP are always delivered through the AND gate 102 to the AND gate 103. The operation mode setting switch 14*a* includes, similarly as the aforementioned switch 14*b*, three switching elements which are preferentially connected for enabling to set preferentially any one of the up-mode, down-mode and turn-mode. The movable contact A is connected to a signal source of a logical "1", and the movable contact C is combined via the contact B with the contact A. The fixed contacts which respectively contact with or separate from the movable contacts A, B and C are connected to the signal source of a logical "0" level respectively through the resistances $R_A$, $R_B$ and $R_C$. With this construction, the turn-mode indicating signal TN, down-mode indicating signal DN and up-mode indicating signal UP may be selected by these switching elements. Assuming that the movable contact of the turn-mode set switching element is in the illustrated condition, the turn mode indicating signal TN is a logical "0" and the output from the inverter 109 is a logical "1". As a result, in this condition, the output from the OR gate 110 is a logical "1" irrespective of the output from the counting blocking signal generator circuit 104, and the next stage clock signals NCP' is the output of the two-input AND gate 103 which receives the AND output from the AND gate 102 together with the OR output from the OR gate 110. The clock signals NCP' are counted by said counter 83 in synchronism with the counting operation by the counter 53. Counting of the clock signals NCP' is blocked when the flip-flop 101 is reset or when the turn-mode indicating signal TN becomes a logical "1" (indicating the turn-mode) and at the same time the counting blocking signal CB becomes a logical "0".

The counting blocking signal generator circuit 104 will now be described. The circuit 104 includes a first three-input AND gate 105*a* having as its input the scanning data $SD_1$ composed of the sequential pulse train $0_1$, the scanning data $SD_6$ composed of the sequential pulse train $S_1$ and the first output $P_1$ from the decoder 94; a second three-input AND gate 105*b* having as its input the scanning data $SD_5$ composed of the sequential pulse train $O_5$, the scanning data $SD_7$ composed of the sequential pulse train $S_{12}$ and the output $Z_2$ from the OR gate 97; OR gate 106 for receiving the outputs from the AND gates 105*a* and 105*b*; a D-flip-flop 107 timed by the block signal $\phi_5$ and for receiving the output from the OR gate 106 at its D input; and an NOR gate 108 having as its input the D-input and Q-output of the flip-flop 107 and outputting the counting blocking signal CB. The AND gate 105*a* performs an AND operation when all of the first outputs $O_1$, $S_1$ and $P_1$ from the decoders 44, 54 and 94 become a logical "1"; and the AND gate 105*b* performs an AND operation when the maximum outputs $O_6$, and $S_{12}$ from these decoders and the OR output $Z_2$ are a logical "1". The outputs from the AND gates 105*a* and 105*b* do, therefore, not take the same logical "1" or "0" level simultaneously, but if either one takes the logical "1" level the other takes the logical "0" level. There is a phase difference corresponding to one clock period of the clock signal $\phi_5$ between the input and output of the flip-flop 107, so that at least one of two inputs of the NOR gate 108 is maintained at the logical "1" level during the period obtained by adding the one clock time to the period during which either of the AND gates 105*a* and 105*b* becomes logical "1". As a result, the counting blocking signal CB becomes a logical "0" during the period which corresponds to the period added with one clock time and in which at least one of the inputs of the NOR gate 108 is maintained at the logical "1" level, thereby block counting of the clock signals NCP by the counter 83 through the OR gate 110 and the AND gate 103. Such blocking of the counting operation is necessary when the turn mode indicating signal TN is a logical "1" (in the turn-mode operation), and as a result of blocking the pulse designating the terminal octave is removed from the next stage clock signal NCP. The counter 83, thus, produces the following outputs X when it repeats counting-up or counting-down operation in the turn-mode over the range of four octaves. Namely, when illustrating the outputs X using decimal notation, the outputs are shown as "1, 2, 3, 4, 4, 3, 2, 1, 1, 2, 3, 4, 4, 3, 2, 1, ----------", in which the first and the fourth octaves, both being terminating octaves, are designated twice in a sequence.

The output from the two-input NOR gate 111 which receives the down-mode indicating signal DN and the inverted output $\overline{Z}_1$ is applied to one of two set input terminals of the flip-flop 112, and the reset signal RST is fed to the other set input terminal. The output $Z_2$ from the OR gate 97 is given to the reset input terminal of the flip-flop 112. To one of two input terminals of the two-input OR gate 113 is applied the up-mode indicating signal UP, and to the other input terminal thereof is applied the output from the flip-flop 112. The AND gate 114 is to receive the output from the OR gate 113 and the down-mode indicating signal DN to generate the clock select control signal $CNT_2$. On the other hand, the NAND gate 115 receives the output from the OR gate 113 and the down-mode indicating signal DN to generate the enable signal EN thereby feeding the signal EN to the frequency divider and selector circuit shown in FIG. 9.

In order to indicate the up-mode operation, the switch 14*a* is manipulated to allow the movable contact A thereof with the fixed contact disposed on the side of the resistance $R_A$ to thereby allow the up-mode indicating signal UP to take the logical "1" level, whereby the up-down control signal $CNT_1$ is allowed to take the logical "1" level and to indicate the up-mode operation. On the other hand, in order to indicate the down-mode operation, the switch 14*a* is similary operated to allow the down-mode indicating signal DN to take the logical "1" level. Subsequently, the output Z from the NOR gate 111 becomes a logical "0" while the signal RST is held at the logical "0" level, so that the output from the flip-flop 112 is allowed to take the logical "1" level. This operation might be considered objectional, for the reason that the up-mode operation of a logical "1" level is indicated notwithstanding that the down-mode operation is precedingly indicated. However, as mentioned hereinbefore, this operation is necessary for temporarily allowing up-mode operation to be performed during the period of down-mode operation to thereby ascertain the depressed key location. The output $CNT_2$ from the AND gate 114 takes the logical "1" level, since the output from the OR gate 113 takes logical "1" level and the signal DN takes the logical "1" level. As a result, the output $CNT_2$ of a logical "1" level is applied to the OR gate 36 of the clock select circuit 30 shown in FIG. 3, and thus the high speed clock signal $\phi_5$ is selected. Subsequently, the counter 93 performs a high speed up-counting operation to output the OR output $Z_2$ for a short period of time for resetting the flip-flop 112, whereby the output $CNT_1$ from the OR gate 113 takes the logical "0" level to indicate the down-mode operation. In order to prevent objectionable sounding during said high speed up-counting operation, the output EN from the NAND gate 115 provided for preventing the same is held at the logical "0" level during the period within which both of the signals DN and $CNT_1$ take the logical "1" level. When the turn-mode operation is set by operating the switch 14*a*, the signal TN takes the logical "1" level and the inverted signal generated through the inverter 109 takes the logical "0" level, whereby the clock signals passing through the AND gate 102 are selected in response to the aforementioned clock blocking signal CB by the AND gate 103. Thus, the counter 83 counts the number of octaves in such a manner that the counted contents are not increased or decreased at both terminal ends of the predetermined octave range. The switchover between the up- and down-countings in the turn-mode operation is controlled by the flip-flop 221. In certain conditions, the control signal $CNT_1$ takes either of the logical "0" or "1" levels. The counter 93 counts the scanned numbers after any of the keys are depressed to start counting. In down-mode operation, the output from the AND gate 95 takes the logical "1" level at a time subsequent to that when all bits of the output from the counter 93 are brought to "0" to allow the inverted output $\overline{Z}_1$ to take the logical "0" level and to allow the NOR output Z to take the logical "1" level for setting the flip-flop 112, whereby the control signal $CNT_1$ is allowed to take a logical "1" to indicate the up-mode operation. On the contrary, the OR output $Z_2$ takes the logical "1" level at a time subsequent to that when the maximum number is counted by the counter 93 in the up-mode operation to reset the flip-flop 112 to allow the control signal to take a logical "0" level to indicate the down-mode operation. The signals Z and $Z_2$ take the logical "1" level alternatively to set or reset the flip-flop 112 so as to allow the output from the flip-flop 112 to take the logical "1" and "0" level alternatively, in response to the control signal $CNT_1$ which takes a logical "1" or "0" level alternatively to indicate up- or down-mode operation.

Referring now to the sounding octave indicating signal generator circuit 120, this circuit 120 includes a sounding limit octave setting switch **14*c*, an encoder 121 for encoding the signals $W_1$ to $W_3$ from the switch 14*c* to obtain binary codes, a first adder 122 for adding the encoded output W to the output X from the counter 83, a second adder 123 for adding the output from the first adder to the output Y from the counter 93, and a decoder 124 for receiving the output from the second adder. Three switching elements of the switch 14*c* are, similarly as in the switches 14*a* and 14*b*, preferentially connected for preferentially setting only one of the limit octave to be sounded. The symbols A, B and C designate movable contacts, and the contact C is adapted to be combined with a signal source of a logical "1" level through the contacts B and A. The symbols $R_A$, $R_B$, and $R_C$ designate resistances, each one end thereof being connected to corresponding one of the fixed contacts of the switching element and the other end thereof are, respectively connected to the signal sources of a logical "0" level. The sounding limit octave indicating signals $W_1$, $W_2$ and $W_3$ output of respective switching elements are encoded in the binary encoder 121 and the encoded output W is the input of first adder 122. The first adder 122 is to add the output X from the counter 83 to the binary code output W from the encoder 121, and the added output therefrom is fed to the second adder 123. The second adder 123 is to add the output from the first adder to the output Y from the counter 93. The decoder 124 decodes the output from the second adder 123** to generate the sounding octave indicating signal OS.

As described above, the operation mode is held at the sounding limit octave release mode when the movable contact of the sounding limit octave release switch 14 is connected to the signal source of a logical "1" level, and the movable contacts A to C of the switch **14*c* shall be held at the positions shown in the drawing. For this reason, it is convenient to mechanically link the switch 14*c* with the switch 14*x* so as to allow three movable contacts A to C of the switch 14*c* to return to the positions shown in the drawing when the switch 14*x* is operated. In such a construction, all of the signals $W_1$, $W_2$ and $W_3$ take the logical "0" level, so that the output OS is substantially equal to the one obtained by decoding the sum of the inputs X and Y which may be denoted by X+Y. In other words, using such a construction, the counter 83 starts to count the number of octaves from the minimum octave in synchronism with the counter 53 in the mode indicated by the action of the switch 14*a*, and thus the output X indicates the octave value of the key depressed octave. The counter 93 also counts the scanning cycles in the mode indicated by the action of the switch 14*a*, and thus the output Y thereof increases one by one as the time of scanning increases. As a result, the output OS obtained by decoding the sum of X and Y indicates the octaves to be sounded which extend over the predetermined octave range higher than the starting octave of the depressed key location in the up-mode operation by the action of the switch 14*b***, or alternatively indicates the octaves to be sounded which extend over the predetermined octave range containing the sequentially lowered octaves toward the terminating octave of depressed key location in the down-mode operation. In the turn-mode operation, the output OS indicates to repeatedly perform the up-mode operation starting from the octave of depressed key location and the down-mode operation terminating at the octave of the depressed key location.

Contrary to the case where the setting of the sounding octave limit is released as described above, when the switch **14*x* is held at the position shown in the drawing and any of the switching elements of the switch 14*c* is operated to allow the corresponding one of the signals $W_1$, $W_2$ and $W_3$ to take the logical "1" level, the binary code output W from the encoder 121 indicates either of the first, second and third octaves. On the other hand, the flip-flop 101 is not set until the first pulse appears in the time division multiplex signals TDM by the operation of detecting the key depression location. As a result, the counter 83 is prevented from counting the clock signals NCP' by AND gate 102 until the key depressed octave is scanned. In other words, the counter 83 begins to count the number of scanned octaves starting from the key-depressed octave to let the same to be the minimum octave in synchronism with the counter 53. The number of the octaves counted by the counter 83 is thus shifted from the octave number which is practically counted by the counter 53 by the number included in the range extending from the minimum octave to the key-depressed octave. Such a counting operation by the counter 83 does not cause any problem if a plurality of keys within the same octave are depressed, but causes problems when a plurality of keys locating over plural octaves are depressed. In the latter mentioned case, the counter 83 starts its counting operation assuming that the initially detected octave included in the plural key-depressed octaves is the minimum octave. Eventually, the output X from the counter 83** designates the first detected key-depressed octave by numeral 0, and designates the secondly detected key-depressed octave by numeral 1. Consequently, the output OS is substantially determined by the sum of the outputs W and Y when one or a plurality of keys locating within the same octave is depressed, since the value X equals zero. In contrast thereto, when a plurality of keys located over plurality octaves is depressed, the output OS is determined by the sum of the outputs W, X and Y. The sounding octave indicating signal OS generated in the manner described above, may be used in the system for selecting and sounding notes together with the aforementioned sounding note designating signal NS, as will be described hereinafter.

Figure 9:
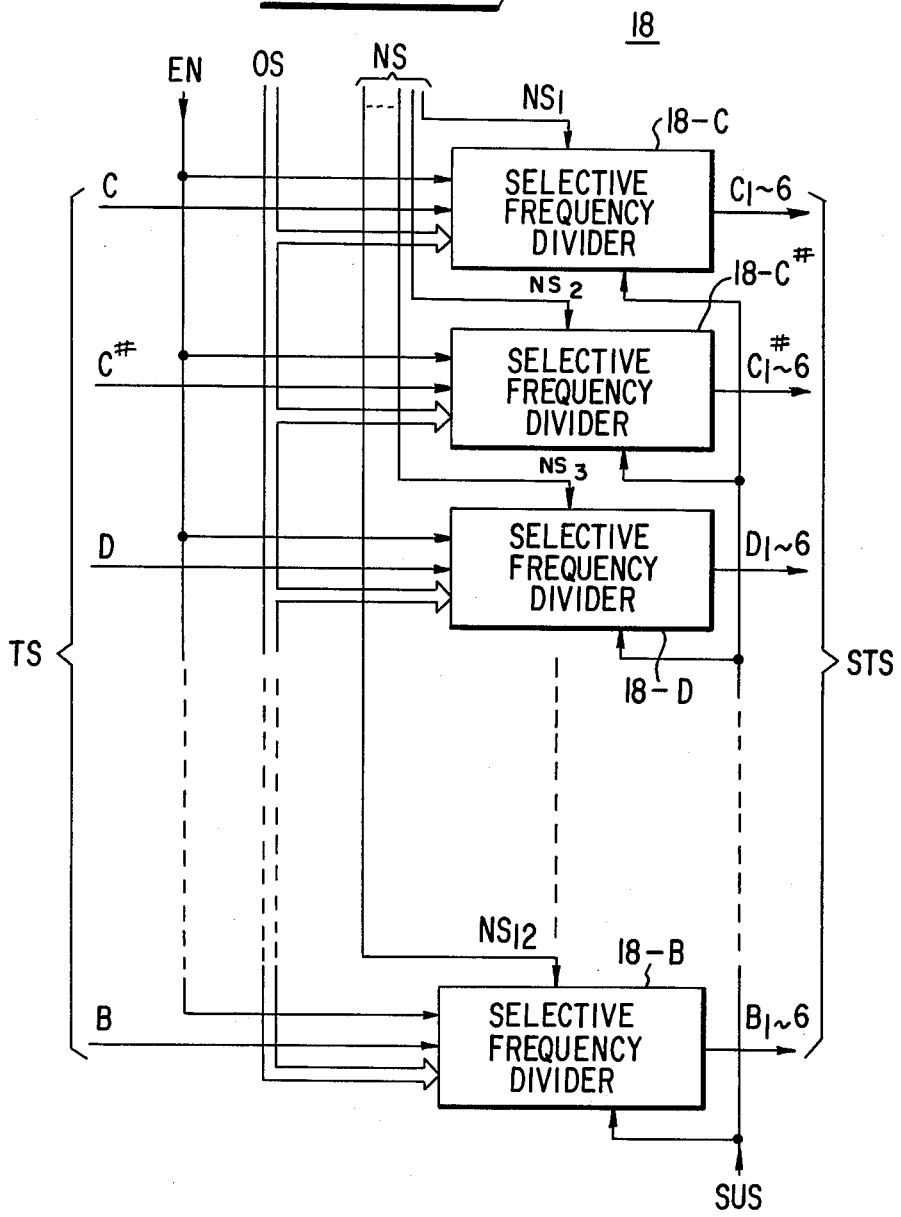
FIG. 9 is a block diagram showing the frequency divider and selection circuit incorporated in the system shown in FIG. 1.

FIG. 9 shows the internal construction of the frequency divider and selector circuit 18 shown in FIG. 1. This circuit 18 includes twelve selective frequency dividers 18-C, 18-C#, 18-D, . . . , and 18-B respectively for receiving tone source signals TS corresponding to twelve tones belonging to the top octave and being generated from the tone generator 16. To each of the selective frequency dividers put-in are the enable signal EN and the sounding octave indicating signal OS, and further applied is the sustain signal SUS fed from the sustain switch 18*a*. With regard to the sounding note designating signal NS, signals $NS_1$, $NS_2$, $NS_3$, . . . , and $NS_{12}$ corresponding to respective notes are applied to respective selective frequency dividers 18-C, 18-C#, 18-D, . . . and 18-B which correspond to respective notes.

When the enable signal EN takes the logical "1" level each of the frequency dividers responds to the sounding octave indicating signal OS and the sounding note designating signal NS to select one signal from the six-octave tone source signals $C_1$ to $C_6$, $C\#_6$ to C#, $D_1$ to $D_6$, $B_1$ to $B_6$ for every twelve tones thereby to generate the selected signal output STS. If the sounding octave indicating signal OS indicates the top octave, the tone source signal itself identifies the note which is same as that designated by the sounding note designating signal NS is selected to form the output. However, if a specific octave which is lower than the top octave is designated by the signal OS, the tone source signal of the tone indicated by the articulated note indicating signal NS is subjected to a frequency division operation in order to allow the same to have a frequency within said specific octave. The sustain signal SUS is generated by operating the switch 18*a* in such a manner that it takes a logical "1" level when the sustain effect is desired and takes a logical "0" level in the other cases.

Figure 10:
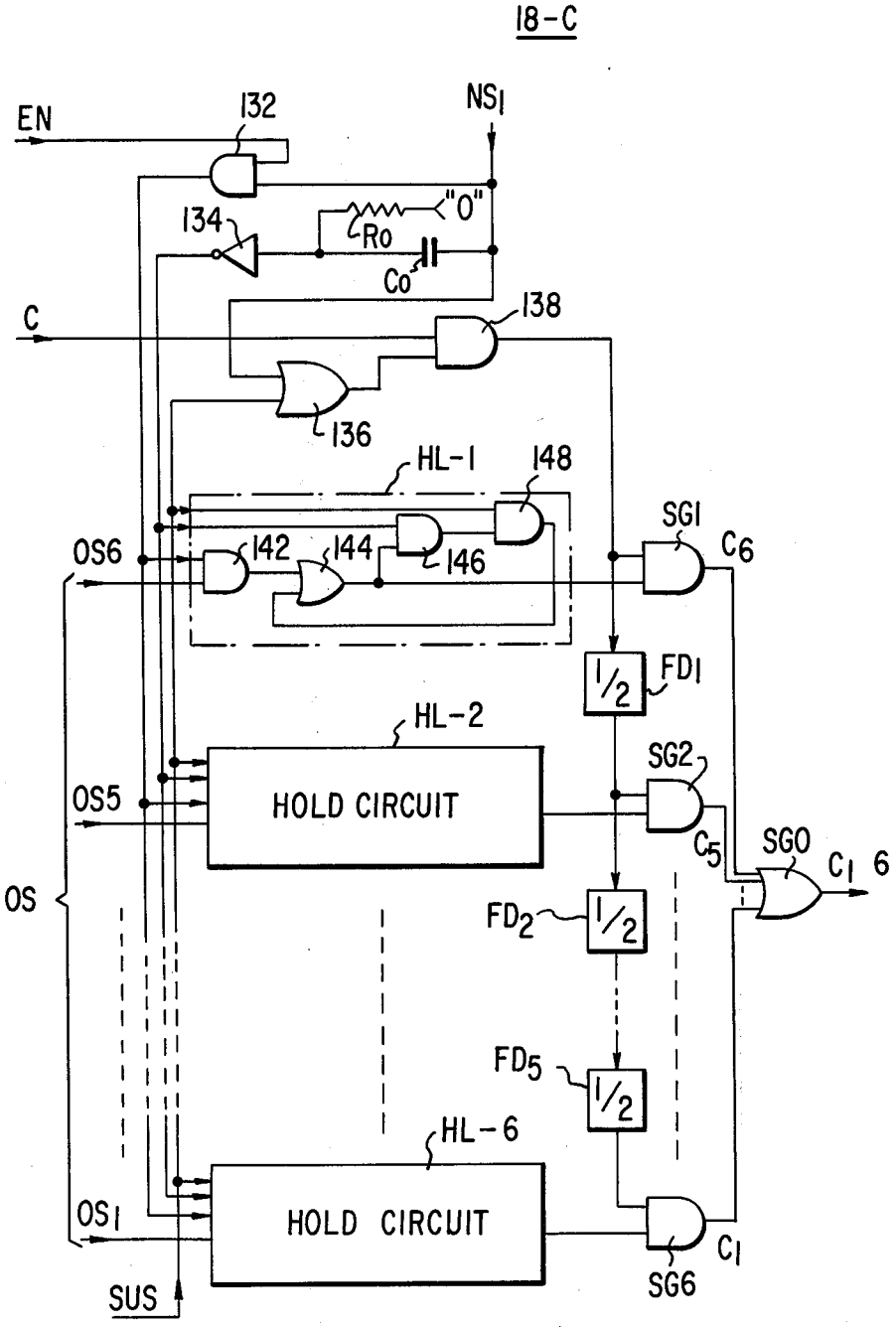
FIG. 10 is a circuit diagram showing the detail of the selective frequency divider for C tone shown in FIG. 9.

Referring to FIG. 10, the construction and operation of said selective frequency divider will now be described. The selective frequency divider 18-C for C tone will be described as one example, but the frequency dividers 18-C# to 18-B for the other tones have similar constructions and operate similarly. There are provided hold circuits HL-1 to HL-6 respectively for receiving the sounding octave indicating signals $OS_1$ to $OS_6$ corresponding to respective octaves, and each of the outputs from the hold circuits HL-1 to HL-6 is applied to each one input terminal of each of the signal select AND circuits $SG_1$ to $SG_6$. The tone source signal C corresponding to the highest C tone is applied to one input terminal of the two-input AND gate 138, and the other input terminal of the AND gate 138 is fed with the sounding note indicating signal $NS_1$ which indicates C tone, and the OR output from the OR gate 136 to which the sustain signal SUS is the input. The output from the AND gate 132 to which the enable signal EN and the sounding note designating signal $NS_1$ the input is fed to the hold circuits HL-1 to HL-6. A differentiator circuit including a resistor $R_0$ and a capacitor $C_0$ delivers the output obtained by differentiating the sounding note designating signal $NS_1$ through the inverter 134 to the hold circuits HL-1 to HL-6. The sustain signal is also put-in the hold circuits HL-1 to HL-6. Each of the hold circuits HL-1 to HL-6 has the same construction as that of the circuit HL-1 which will be exemplarily described hereinbelow.

The hold circuit HL-1 includes and AND gate 142 being fed with the top octave indicating signal $OS_6$ and the output from the AND gate 132 as the inputs thereof, an OR gate 144 being fed with the output from said AND gate 142 and the output from another AND gate 148 as the inputs thereof, an AND gate 146 being fed with the output from said OR gate 144 and the output from the inverter 134 as the inputs thereof, and an AND gate 148 being fed with the output from said AND gate 146 and the sustain signal SUS as the inputs thereof. The output from the OR gate 144 is the output of the hold circuit HL-1. Other hold circuits HL-2 to HL-6 have similar construction as that of the aforementioned circuit HL-1, the only difference being the sounding octave indicating signals OS which are respectively the inputs of each of the circuits. Between the other input terminals of the AND gates $SG_1$ to $SG_6$ which receive the outputs from the hold circuits HL-1 to HL-6 at their one input terminals are respectively connected to ½ frequency dividers $FD_1$ to $FD_5$ as illustrated in the drawing, the output from the AND gate 138 is fed to the input terminal of the frequency divider $FD_1$ which is connected to the other input terminal of the Gate SG.

In operation, the circuit shown in FIG. 10, after any of the keys are depressed and the key switches are scanned, the sounding octave indicating signal OS and the sounding note designating signal NS corresponding to the location of the depressed key is fed from the system described with reference to FIGS. 1 to 8. Assuming now that the signals $NS_1$ and $OS_6$ are fed, the sounding note designating signal $NS_1$ enables the AND gate 138 through the OR gate 136, such that the tone source signal C is fed to the frequency divider $FD_1$ and to the AND gate $SG_1$. The enable signal EN and the signal $NS_1$ both taking the logical "1" level causes an output of a logical "1" level from the AND gate 132, and this AND output enables the AND gate 142. As a result, the sounding octave indicating signal $OS_6$ is delivered through the AND gate 142 and further through the OR gate 144 to the AND gate $SG_1$. Consequently, the musical tone signal corresponding to C tone in the top octave, i.e. the tone $C_6$, is obtained at the output terminal of the AND gate $SG_1$, which is delivered through the OR gate $SG_0$ to the following tone keyer circuit.

When the sustain signal SUS is held at the logical "1" level in order for obtaining the sustain effect, both of the two inputs of the AND gate 146 are allowed to take the logical "1" level and thus both of the two inputs of the AND gate are allowed to take the logical "1" level. As a result, even after the octave indicating signal $OS_6$ stops to take the logical "1" level, the output from the AND gate 148 is still held at the logical "1" level and also the output from the OR gate 144, i.e. the output from the hold circuit HL-1 retains the logical "1" level. On the other hand, the OR gate 136 outputs a logical "1" even after the signal NS ceases to take the logical "1" level, since the sustain signal is held at the logical "1" level. As a consequence, when the sustain switch 18*a* is operated to let the sustain signal SUS be at the logical "1" level, the tone source signal C is selected even after the pulses of the signals $NS_1$ and $OS_6$ ceases to be supplied. In the course of the above operation, generation of the tone source signal output $C_6$ is terminated when the same depressed key is scanned by the second scanning operation and the differentiator circuit ($R_0$, $C_0$) generates the pulse (at the logical "1" level) by differentiating the rising portion of the note designating signal $NS_1$ corresponding to the note of the depressed key, and then said pulse is delivered through the inverter 134 to the AND gate 146 to inhibit the same.

Tone source signals in the octaves lower than the top octave may be selected following a generally similar operations as in the aforementioned operation except that different frequency division outputs divided by the frequency dividers $FD_1$ to $FD_5$ in accordance with the designated octave are respectively selected by the AND gates $SG_2$ to $SG_6$, whereby the musical tone signals $C_5$ to $C_1$ are generated. More than one of the musical tone signals $C_6$ to $C_1$ are delivered to the next stage by the OR gate $SG_6$.

Figure 11:
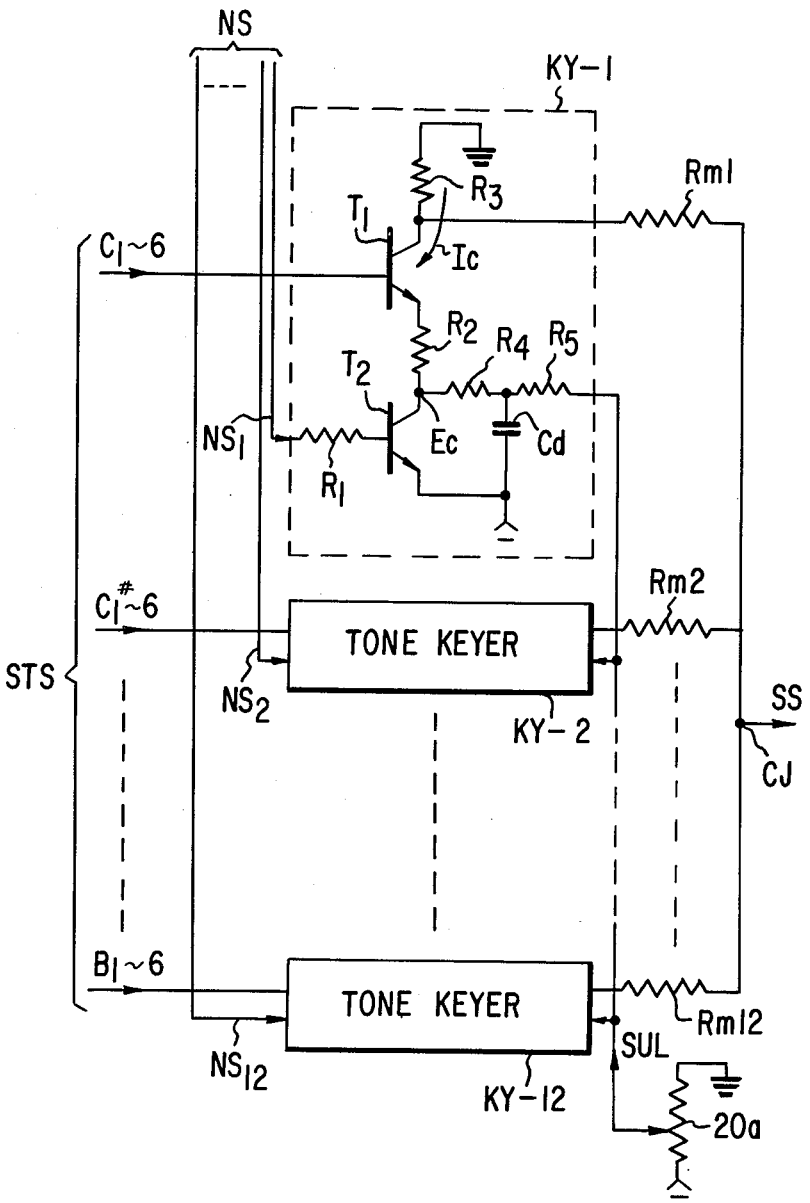
FIG. 11 is a circuit diagram showing the tone keyers incorporated in the system shown in FIG. 1.

FIG. 11 shows an example of the tone keying circuit 20 for receiving the selected signal STS composed of the tone source signals selected as described above. The circuit 11 includes twelve tone keyers KY-1 to KY-12 which correspond to twelve notes mixing resistors $R_{m1}$ to $R_{m12}$ which are connected in series with respective outputs of these keyers KY-1 to KY-12, and a variable resistance 20*a* for determining the sustain time. The switched tone source signal SS is the output of the common connection CJ of the mixing resistances $R_{m1}$ to $R_{m12}$. The input to the tone keyers KY-1 to KY-12 is the corresponding tone source signals $C_{1-6}$ to $B_{1-6}$ and further applied are corresponding sounding note designating signals $NS_1$ to $NS_{12}$. The sustain length indicating signal SUL is applied to each of the tone keyers KY-1 to KY-12.

The tone keyers KY-1 to KY-12 have similar constructions. The detailed construction of the circuit KY-1 will be exemplarily illustrated in the following descriptions. The tone keyer KY-1 is provided with a first switching transistor $T_1$ having a load resistance $R_3$ connected between the collector and the ground point, and a second switching transistor $T_2$ having an emitter connected to a negative voltage source and having a collector connected through a resistance $R_2$ to the emitter of the first transistor $T_1$. The selected tone source signals $C_1$ to $C_6$ are fed to the base of the transistor $T_1$, and the note designating signal $NS_1$ is fed through the resistance $R_1$ to the base of the transistor $T_2$. The one terminal end of the variable resistance 20*a* is grounded, and the other end thereof is connected to a negative voltage source. To the movable contact of the variable resistance 20*a* is connected the one end of a resistance $R_5$ which has the other end connected to the interconnecting point of a resistance $R_4$ and a $C_d$ which are connected in series between the collector and emitter of the transistor $T_2$.

The switching operation without accompanying sustain effect will be explained. The transistor $T_2$ is brought to the on- or off-state by the sounding note designating signal $NS_1$ which takes the logical "1" or "0" level, whereby the transistor $T_1$ is to be the on- or off-state. The transistor $T_1$ is, therefore, operated to be on- or off-condition by the tone source signals $C_1$ to $C_6$ in response to the frequency of said tone source signals during the period at which the transistor $T_2$ is held at the on-state, and the output generated at the collector thereof is passed through the resistance $R_{m1}$ to the connecting point CJ to form the output SS. Under such a condition, if similar keyed outputs are generated from the other tone keyers KY-2 to KY-12, the switching outputs are passed through the corresponding mixing resistances $R_{m2}$ to $R_{m12}$ to the connection point CJ and mixed the switched outputs delivered through the resistance $R_{m1}$ to form the put-out SS.

When accompanied with the sustain effect, the aforementioned switching-mixing operation is changed to perform the following operation. In such a mode of operation, the tone source signal output is generated during the period obtained by adding the original oscillating period $t_k$ (i.e. the sounding period without the sustain effect) to a damping oscillation period $t_s$. Such a signal output is obtained, because the transistor $T_1$ is gradually turned off by charging the capacitor $C_d$. The capacitor $C_d$ is charged with the divided voltage output from the variable resistance 20*a* when the transistor $T_2$ is in the state. When any of keys are depressed to allow the note designating signal $NS_1$ to take the logical "1" level, the transistor $T_2$ is turned on and the capacitor C discharges its potential through the transistor $T_2$ and the transistor $T_1$ is simultaneously turned on to pass there through the tone source signals $C_1$ to $C_6$. The transistor $T_2$ is turned off by the signal $NS_1$ which is changed to take the logical "0" level, followed by an increase in collector voltage $E_c$ of the transistor $T_2$ and a decrease in collector current $I_c$ of the transistor $T_1$. As a result, after the lapse of the period $t_k$, the amplitude of the switching output from the collector side of the transistor $T_1$ is damped gradually, and the tone source signal SS is allowed to have damping period (sustain period) $t_5$. The length of the period $t_5$ may be arbitrarily determined by operating the variable resistance 20*a*.

As mentioned hereinbefore with reference to FIG. 1, the switched tone source signal SS is delivered through the output amplifier 22 to the electro-acoustic converter 24 to be articulated from the converter as a form of musical tone.

As is apparent from the foregoing descriptions, the electronic musical instrument embodying the present invention may be used for automatically playing various arpeggios automatically by determining the operation mode, the octave width to be sounded and the sounding limit octave as desired thereby to enrich the playing and to effectively lessen the complexity of key operation during playing.

The present invention is not limited only to the specific embodiment described above, but it may be practiced in various modified manners, for example the system of the invention may be introduced in a software for a computer. Furthermore, it should be apparent that the AND gates, OR gates, Adders, Differentiators, etc., are circuit common in the prior art.

In all cases, it is understood that the above described embodiments is merely illustrative of but one of the many possible specific embodiments which represent the applications of the principles of the present invention. Numerous and varied other arrangements can be readily devised by those skilled in the art without departing from the spirit and scope of the invention:

I claim:

1. A method for automatically playing arpeggio in an electronic musical instrument having keys for playing said instrument, key scanning means sequentially and repetitively scanning said keys at a high rate where a key is not depressed and at a low rate where a key is depressed to produce data signals identifying played keys among said keys, and tone producing means producing tone signals of tones designated by said data signals, said method comprising the steps of:

(a) counting the number of times of said scanning, and (b) modifying said data signals by the number counted in said step (a) to shift in at least a one predetermined direction the designated notes for tone production from a first selectable predetermined octave to a second selectable predetermined octave in an amount of octaves corresponding to said counted number.

2. A method of automatically playing arpeggio according to claim 1, further comprising steps of moving directly back to said first predetermined octave after shifting from said first to said second predetermined octaves, such shifting being repeated cyclically.

3. A method of automatically playing arpeggio to claim 2, wherein said first predetermined octave is an octave which is lower than said second predetermined octave.

4. A method of automatically playing arpeggio according to claim 3, wherein said first predetermined octave is an octave to which a played key belongs.

5. A method of automatically playing arpeggio according to claim 3, wherein said first predetermined octave is an octave which is set by an instrument player independently of the octave of a played key.

6. A method of automatically playing arpeggio according to claim 2, wherein said first predetermined octave is an octave which is higher than said second predetermined octave.

7. A method of automatically playing arpeggio according to claim 6, wherein said second predetermined octave is an octave to which a played key belongs.

8. A method of automatically playing arpeggio according to claim 6, wherein said second predetermined octave is an octave which is set by an instrument player independently of the octave of a played key.

9. A method of automatically playing argeggio according to claim 1 further comprising the steps of moving octave by octave back to reach said first predetermined octave after shifting from said first to said second predetermined octave, such shifting being repeated cyclically.

10. A method of automatically playing arpeggio according to claim 9, wherein said first predetermined octave is an octave to which the played key belongs.

11. A method of automatically playing arpeggio according to claim 9, wherein said first predetermined octave is an octave which is set by an instrument player independently of the octave of a played key.

12. An apparatus for automatically playing arpeggio in an electronic musical instrument comprising:

(a) keys for playing the instrument;
(b) key scanning means sequentially and repetitively scanning said keys to produce data signals identifying played keys among said keys;
(c) tone designating means receiving said data signals and producing tone designating signals each including a note name designating value and an octave name designating value;
(d) counting means connected to said key scanning means and counting the number of times of said scanning;
(e) octave shifting means connected to said counting means and to said tone designating means for changing said octave name designating value according to the output of said counting means; and
(f) tone producing means producing tone signals corresponding to note name designating values from said tone designating means and octave name designating values from said octave shifting means whereby said tone signals shift octave by octave from a first selectable predetermined octave.

13. An apparatus for automatically playing arpeggio according to claim 12, wherein said counting means delivers, in response to its counting input, an output value which starts at a first value, changes one by one to reach a second value, and changes skippingly back to said first value, such change being repeated cyclically.

14. An apparatus for automatically playing arpeggio according to claim 13, wherein said first value is a value smaller than said second value.

15. An apparatus for automatically playing arpeggio according to claim 13, wherein said first value is a value larger than said second value.

16. An apparatus for automatically playing arpeggio according to claim 12, wherein said counting means delivers, in response to its counting input, an output value which starts at a first value, changes one by one to reach a second value, and changes one by one back to reach said first value, such change being repeated cyclically.

17. An apparatus according to claim 12 further comprising a means for selecting said first predetermined octave.

* * * * *